US011411323B2

(12) United States Patent
Wu et al.

(10) Patent No.: US 11,411,323 B2
(45) Date of Patent: Aug. 9, 2022

(54) COMPACT WIDEBAND DUAL-POLARIZED RADIATING ELEMENTS FOR BASE STATION ANTENNA APPLICATIONS

(71) Applicant: CommScope Technologies LLC, Hickory, NC (US)

(72) Inventors: Bo Wu, Suzhou (CN); Changfu Chen, Suzhou (CN); YueMin Li, Suzhou (CN); Mohammad Vatankhah Varnoosfaderani, Richardson, TX (US); Jian Zhang, Suzhou (CN); Fan He, Suzhou (CN); Peter J. Bisiules, LaGrange Park, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/151,854

(22) Filed: Jan. 19, 2021

(65) Prior Publication Data

US 2021/0226344 A1 Jul. 22, 2021

(30) Foreign Application Priority Data

Jan. 20, 2020 (CN) ..... 202010061865.4
Mar. 12, 2020 (CN) ..... 202010168550.X

(51) Int. Cl.
*H01Q 21/06* (2006.01)
*H01Q 1/24* (2006.01)
(Continued)

(52) U.S. Cl.
CPC ..... *H01Q 21/065* (2013.01); *H01Q 1/246* (2013.01); *H01Q 9/0407* (2013.01); *H01Q 13/10* (2013.01); *H01Q 21/0075* (2013.01)

(58) Field of Classification Search
CPC .... H01Q 21/0075; H01Q 21/06; H01Q 21/08; H01Q 21/26; H01Q 1/246; H01Q 9/0407; H01Q 5/10; H01Q 5/30
See application file for complete search history.

(56) References Cited

U.S. PATENT DOCUMENTS 7,064,725 B2 6/2006 Shtrikman et al.
10,270,177 B2 4/2019 Lindmark
(Continued)

FOREIGN PATENT DOCUMENTS

WO 2014062513 A1 4/2014
WO 2015124573 A1 8/2015
(Continued)

OTHER PUBLICATIONS

"Photos of Radiating Element (Admitted Prior Art)".
"Extended European Search Report for European Application No. 21152353.5, dated Jun. 7, 2021, 9 pages".

*Primary Examiner* — Jason Crawford
(74) *Attorney, Agent, or Firm* — Myers Bigel, P.A.

(57) ABSTRACT

Radiating elements include a conductive patch having first and second slots that each extend along a first axis and third and fourth slots that each extend along a second axis that is perpendicular to the first axis, a feed network that includes first through fourth feed lines, each feed line crossing a respective one of the first through fourth slots, and a conductive ring that at least partially surrounds the periphery of the conductive patch and that encloses each of the first through fourth slots.

20 Claims, 20 Drawing Sheets

(51) Int. Cl.

| | |
|---|---|
| ***H01Q 21/00*** | (2006.01) |
| ***H01Q 9/04*** | (2006.01) |
| ***H01Q 13/10*** | (2006.01) |

(56) References Cited

U.S. PATENT DOCUMENTS

| | | | | |
|---|---|---|---|---|
| 2002/0163477 | A1 | 11/2002 | Eriksson | |
| 2007/0241983 | A1 | 10/2007 | Cao et al. | |
| 2013/0141296 | A1 | 6/2013 | Jaffri et al. | |
| 2014/0035698 | A1* | 2/2014 | Schadler | H01Q 21/0075 333/128 |
| 2017/0294704 | A1* | 10/2017 | Sun | H01Q 21/062 |
| 2018/0294550 | A1 | 10/2018 | Segador Alvarez et al. | |
| 2019/0051961 | A1* | 2/2019 | Karlsson | H01Q 21/0006 |
| 2019/0252777 | A1 | 8/2019 | Lindmark | |
| 2019/0334636 | A1* | 10/2019 | Li | H01P 1/184 |
| 2020/0343642 | A1* | 10/2020 | Chen | H01Q 9/28 |
| 2020/0373668 | A1* | 11/2020 | Wu | H01Q 5/314 |
| 2021/0226344 | A1* | 7/2021 | Wu | H01Q 21/0075 |
| 2021/0320399 | A1* | 10/2021 | Bisiules | H01Q 21/24 |
| 2022/0052442 | A1* | 2/2022 | Varnoosfaderani | H01Q 1/246 |
| 2022/0069452 | A1* | 3/2022 | Li | H01P 1/18 |

FOREIGN PATENT DOCUMENTS

| | | | |
|---|---|---|---|
| WO | 2017178037 | A1 | 10/2017 |
| WO | 2018205277 | A1 | 11/2018 |
| WO | 2020151049 | A1 | 7/2020 |

* cited by examiner

COMPACT WIDEBAND DUAL-POLARIZED RADIATING ELEMENTS FOR BASE STATION ANTENNA APPLICATIONS

CROSS-REFERENCE TO RELATED APPLICATIONS

The present application claims priority to Chinese Patent Application 202010061865.4, filed Jan. 20, 2020, and to Chinese Patent Application 202010168550.X, filed Mar. 12, 2020, the entire content of both of which are incorporated herein by reference.

BACKGROUND

The present invention generally relates to radio communications and, more particularly, to radiating elements for base station antennas used in cellular communications systems.

Cellular communications systems are well known in the art. In a cellular communications system, a geographic area is divided into a series of regions that are referred to as "cells" which are served by respective base stations. The base station may include one or more base station antennas that are configured to provide two-way radio frequency ("RF") communications with mobile subscribers that are within the cell served by the base station. The base station antennas are often mounted on a tower, with the radiation patterns (also referred to herein as "antenna beams") that are generated by the base station antennas directed outwardly. Many cells are divided into "sectors." In perhaps the most common configuration, a hexagonally-shaped cell is divided into three 120° sectors, and each sector is served by one or more base station antennas that generate antenna beams that have an azimuth Half Power Beamwidth (HPBW) of approximately 65°. Typically, a base station antenna includes multiple phase-controlled antenna arrays that each include a plurality radiating elements that are arranged in one or more vertical columns when the antenna is mounted for use. Herein, "vertical" refers to a direction that is perpendicular to the horizontal plane that is defined by the horizon. Each antenna array generates a respective antenna beam, or two antenna beams if the antenna array is formed with dual-polarized radiating elements. The phase controlled antenna arrays include columns of radiating elements (as opposed to a single radiating element) in order to narrow the vertical or "elevation" beamwidth of the antenna beam, which may both increase the gain of the array and reduce interference with adjacent cells.

In order to accommodate the ever-increasing volume of cellular communications, cellular operators have added cellular service in a variety of new frequency bands. Cellular operators have applied a variety of approaches to support service in these new frequency bands, including increasing the number of linear arrays (or planar arrays) of radiating elements per antenna. As more columns of radiating elements are added to a typical antenna, efforts have been made to decrease the sizes of the radiating elements in order to reduce interactions between adjacent columns of radiating elements. Additionally, as the number of radiating elements included in an antenna increases, the advantage of lowering the unit cost of the radiating elements increases.

SUMMARY

Pursuant to embodiments of the present invention, radiating elements are provided that include a conductive patch having first and second slots that each extend along a first axis and third and fourth slots that each extend along a second axis that is perpendicular to the first axis, a feed network that includes first through fourth feed lines, each feed line crossing a respective one of the first through fourth slots, and a conductive ring that at least partially surrounds a periphery of the conductive patch and that encloses each of the first through fourth slots.

In some embodiments, the conductive ring may be a continuous ring that completely surrounds the conductive patch when the radiating element is viewed in plan view.

In some embodiments, the conductive ring may have a plurality of sections, and each section may enclose a respective one of the first through fourth slots.

In some embodiments, the feed network may further include a first input, a first power divider that is coupled to the first input, a second input, and a second power divider that is coupled to the second input, and the first and second feed lines may be coupled to respective first and second outputs of the first power divider, and the third and fourth feed lines may be coupled to respective first and second outputs of the second power divider.

In some embodiments, at least a portion of the conductive patch may be implemented on a first metal layer of a printed circuit board, where the first through fourth feed lines comprise metal traces on a second metal layer of the printed circuit board, and where each of the first through fourth slots extend to the periphery of the conductive patch.

In some embodiments, the second metal layer of the printed circuit board may further include a plurality of metal pads that are each electrically connected to the conductive patch via one or more plated through holes that extend between the first and second metal layers of the printed circuit board.

In some embodiments, the conductive patch may include a first portion that is implemented on a first metal layer of a printed circuit board and a second portion that is implemented on a different metal layer of the printed circuit board. In some embodiments, the different metal layer of the printed circuit board may be the second metal layer of the printed circuit board.

In some embodiments, the conductive ring may be electrically floating. In other embodiments, the conductive ring may be electrically connected to the conductive patch. In some embodiments, the conductive ring may be coplanar with at least a portion of the conductive patch.

Pursuant to further embodiments of the present invention, radiating elements for a base station antenna are provided that include a printed circuit board that includes a conductive patch having first and second slots that each extend along a first axis and third and fourth slots that each extend along a second axis that is perpendicular to the first axis, a first coaxial cable and a second coaxial cable that each extend from a reflector of the base station antenna to the printed circuit board, and a conductive stub that physically and electrically connects an outer conductor of the first coaxial cable to an outer conductor of the second coaxial cable.

In some embodiments, the printed circuit board may be mounted forwardly from the reflector at a distance that is greater than one-quarter of a wavelength corresponding to the center frequency of the operating frequency band of the radiating element.

In some embodiments, the conductive stub may be located at approximately one quarter of the wavelength corresponding to the center frequency of the operating frequency band of the radiating element from the printed circuit board. In some embodiments, the conductive stub may be located closer to the reflector than it is to the printed circuit board.

In some embodiments, the outer conductors of the first and second coaxial cables may be soldered to the printed circuit board.

In some embodiments, the radiating element may further include first and second conductive tubes that are positioned adjacent the first and second coaxial cables.

In some embodiments, the printed circuit board may further include a feed network that has a first input that is electrically connected to an inner conductor of the first coaxial cable, a first power divider that is coupled to the first input, first and second transmission lines that extend from the first power divider to cross the respective first and second slots, a second input that is electrically connected to an inner conductor of the second coaxial cable, a second power divider that is coupled to the second input, and third and fourth transmission lines that extend from the second power divider to cross the respective third and fourth slots.

In some embodiments, the conductive patch may be implemented at least partially on a first metal layer of the printed circuit board, where the feed network is implemented on a second metal layer of the printed circuit board, where the second metal layer further includes a plurality of metal pads that are each electrically connected to the conductive patch, and where each of the first through fourth slots extend to a periphery of the conductive patch.

Pursuant to still further embodiments of the present invention, radiating elements for a base station antenna are provided that include a printed circuit board that includes a conductive patch having first and second slots that each extend along a first axis and third and fourth slots that each extend along a second axis that is perpendicular to the first axis and a feed stalk that mounts the printed circuit board in front of a reflector of the base station antenna. A first metal layer of the printed circuit board includes a first portion of the conductive patch and a second metal layer of the printed circuit board includes a second portion of the conductive patch.

In some embodiments, the first portion of the conductive patch may be capacitively coupled to the second portion of the conductive patch. In other embodiments, the first portion of the conductive patch may be galvanically connected to the second portion of the conductive patch.

In some embodiments, the printed circuit board may further include a feed network that includes a first input, a first power divider that is coupled to the first input, and first and second transmission lines that extend from the first power divider to cross the respective first and second slots, and a second input, a second power divider that is coupled to the second input, and third and fourth transmission lines that extend from the second power divider to cross the respective third and fourth slots.

In some embodiments, the feed network may be implemented on the second metal layer of the printed circuit board.

In some embodiments, the first portion of the conductive patch may comprise a central portion of the conductive patch and the second portion of the conductive patch may comprise a first annular-shaped metal layer having an inner portion that overlaps the central portion of the conductive patch and an exterior portion that extends outwardly beyond the central portion of the conductive patch.

In some embodiments, the conductive patch may further include a third portion that comprises a second annular-shaped metal layer having an inner portion that overlaps the first annular-shaped metal layer of the second portion of the conductive patch and an exterior portion that extends outwardly beyond the first annular-shaped metal layer of the second portion of the conductive patch.

In some embodiments, the third portion of the conductive patch may be implemented in the first metal layer.

In some embodiments, each of the first through fourth slots may extend to a periphery of the conductive patch.

Pursuant to additional embodiments of the present invention, radiating elements for a base station antenna are provided that include a conductive patch having first through fourth slots that each extend along a first axis and fifth through eighth slots that each extend along a second axis that is perpendicular to the first axis, each of the first through fourth slots extending to a periphery of the conductive patch, the first through eighth slots dividing the conductive patch into four conductive arms and a first trace that extends from the first conductive arm to the second conductive arm to separate the first slot from the second slot.

In some embodiments, a second trace that extends from the second conductive arm to the third conductive arm to separate the fifth slot from the sixth slot, a third trace that extends from the third conductive arm to the fourth conductive arm to separate the third slot from the fourth slot, and a fourth trace that extends from the fourth conductive arm to the first conductive arm to separate the seventh slot from the eighth slot.

In some embodiments, the radiating element may further include a feed stalk that mounts a printed circuit board in front of a reflector of the base station antenna.

Pursuant to further embodiments of the present invention, methods of suppressing a common mode resonance in a base station antenna are provided. The base station antenna may include at least a reflector, an array of first radiating elements that are configured to operate in a first operating frequency band and an array of second radiating elements that are configured to operate in a second operating frequency band. Each second radiating element includes a radiator unit that is positioned forwardly of the reflector and at least one coaxial feed cable that connects to the radiator unit. Pursuant to these methods, an outer conductor of a first of the coaxial feed cables that feeds a first of the second radiating elements is electrically connected to the reflector at a grounding position that is selected so that the physical distance of the RF transmission path that extends between the grounding position and the radiator unit of the first of the second radiating elements is a distance that is not resonant at any frequency in the first operating frequency band.

In some embodiments, the grounding position may be a position where an outer conductor of the first of the coaxial feed cables is galvanically connected to a rear surface of the reflector. For example, the first of the coaxial feed cables may be galvanically connected to a rear surface of the reflector by exposing a portion of the outer conductor and soldering the exposed portion of the outer conductor to the reflector. The first of the coaxial feed cables may extend between the radiator unit and a printed circuit board, and the printed circuit board may include a grounding tab where a ground conductor of the printed circuit board is coupled to the reflector.

In some embodiments, the physical distance of the RF transmission path that extends between the grounding position and the radiator unit of the first of the second radiating elements may be the sum of the length of the first of the coaxial feed cables and a distance between the location where the first of the coaxially feed cables connects to the printed circuit board and the grounding tab.

The physical distance of the RF transmission path that extends between the grounding position and the radiator unit of the first of the second radiating elements may, for example, not be a multiple of a quarter wavelength of any frequency in the first operating frequency band.

In some embodiments, a second of the coaxial feed cable may also feed the first of the second radiating elements, and a conductive stub may physically and electrically connect an outer conductor of the first of the coaxial feed cables to an outer conductor of the second of the coaxial feed cables. In such embodiments, the radiator unit of first of the second radiating elements may be mounted forwardly from the reflector at a distance that is greater than one-quarter of a wavelength corresponding to the center frequency of the second operating frequency band, and the conductive stub may be located at approximately one quarter of the wavelength corresponding to the center frequency of the second operating frequency band of the radiating element from the radiator unit. In some embodiments, the conductive stub may be located closer to the reflector than it is to the radiator unit.

DETAILED DESCRIPTION

Figure 1A:
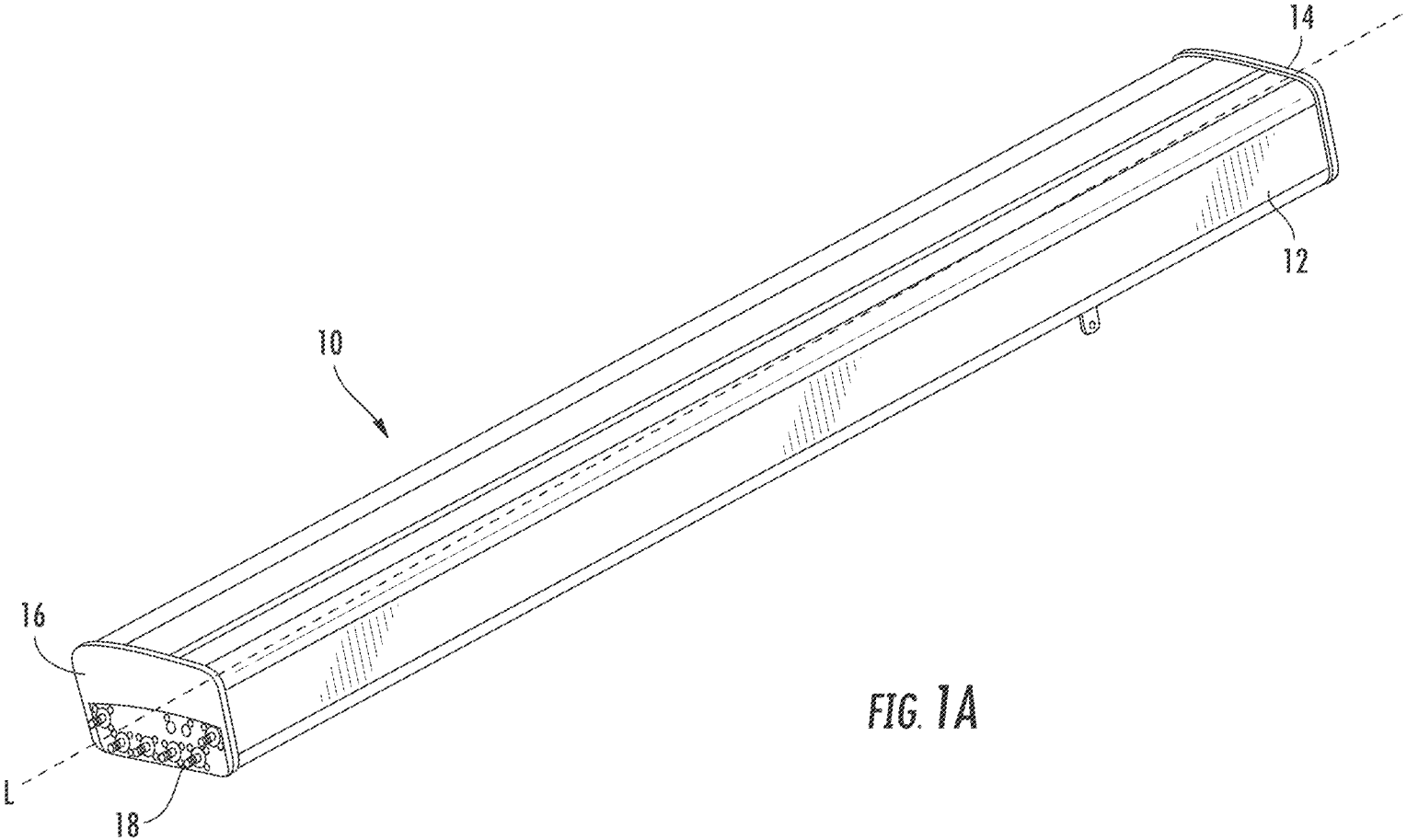
FIG. 1A is a side perspective view of a base station antenna according to embodiments of the present invention.

Pursuant to embodiments of the present invention, small, low-cost dual-polarization radiating elements are provided that are suitable for use in base station antennas. In some embodiments, the radiating elements may be configured to operate in the 1427-2690 MHz frequency band or a portion thereof. For example, in some embodiments the radiating elements may be designed to operate in the 1695-2690 MHz frequency band. It will be appreciated, however, that the radiating elements according to embodiments of the present invention may be scaled to operate in other frequency bands. The radiating elements may exhibit high levels of port-to-port isolation, good cross-polarization discrimination, low insertion loss and suitable azimuth beamwidth performance across a wide operating frequency band.

In some embodiments, the radiating elements may include a radiator unit and a feed stalk. The feed stalk may be used to mount the radiator unit a suitable distance forwardly of a reflector of a base station antenna. The radiating element may optionally include a director and a director support. The radiator unit may comprise a conductive patch that has first and second slots that extend along a first axis and third and fourth slots that extend along a second axis that is perpendicular to the first axis. Each of the first through fourth slots may extend from a periphery of the conductive patch towards the middle or "central region" of the conductive patch, and the four slots may divide the conductive patch into four arms. Each arm may be a generally pie-shaped wedge in some embodiments, and the four arms may be electrically connected to each other in a central region of the conductive patch.

In some embodiments, the radiator unit may be implemented using a printed circuit board. In such embodiments, the printed circuit board may include a first metallization layer that includes at least a portion of a conductive patch and a second metallization layer that includes a feed network, where the two metal layers are separated by a dielectric layer. In some embodiments, the conductive patch may be implemented in its entirety on the first metallization layer of the printed circuit board, while in other embodiments, a second portion of the conductive patch may be implemented on a different metallization layer which may be the second metallization layer and/or a third metallization layer in various embodiments. In other embodiments, the conductive patch may be a sheet metal patch and any suitable feed network may be used to feed RF signals to the slots in the sheet metal patch. The conductive patch may have any appropriate shape including a circular shape, a square shape, an octagonal shape, etc. As shown in the drawings, the conductive patch may also be a variation and/or an approximation of such shapes.

The feed network may include first through fourth feed lines, where each feed line crosses a respective one of the first through fourth slots. The feed lines may be implemented as microstrip transmission lines or coplanar waveguide transmission lines in example, non-limiting embodiments. The feed network may also include a first input, a first power divider that is coupled to the first input, a second input, and a second power divider that is coupled to the second input. The first and second feed lines may be coupled to respective first and second outputs of the first power divider, and the third and fourth feed lines may be coupled to respective first and second outputs of the second power divider.

In some embodiments, the radiator unit may further include a conductive ring that at least partially surrounds the periphery of the conductive patch and encloses each of the first through fourth slots. In some embodiments, the conductive ring may be a continuous metal ring that completely surrounds the conductive patch, while in other embodiments, the conductive ring may comprise a plurality of sections, wherein each section encloses a respective one of the first through fourth slots. The conductive ring may be electrically connected to ground or may be electrically floating. The conductive ring may capacitively load the conductive patch, which may improve the cross-polarization discrimination performance of the radiating element, particularly at lower frequencies.

In some embodiments, the feed stalk may comprise a pair of coaxial feed cables that couple respective first and second RF ports of an antenna to the radiator unit. The feed stalk may further include a structural support such as, for example, a plastic support stalk. The structural support may be used to mount the radiator unit in front of the reflector and/or to maintain the coaxial feed cables in proper position for connecting to the radiator units. In order to increase the bandwidth of the radiating element, the feed stalk may mount the radiator unit more than a quarter wavelength in front of the reflector of the base station antenna in which the radiating element is used, where the wavelength refers to the wavelength corresponding to the center frequency of the operating frequency band of the radiating element. In some embodiments, the outer conductors of the two coaxial feed cables may be soldered or otherwise electrically connected together. For example, the two outer conductors may be soldered together at a distance of approximately one quarter wavelength from the radiator unit. This may improve the port-to-port isolation performance of the radiating element. A pair of metal rods may be provided on either side of the coaxial feed cables. The rods may provide a more symmetric structure behind the radiator unit, which may help improve the port-to-port isolation performance of the radiating element.

In still other embodiments, the conductive patch may be elongated in the vertical direction, which may narrow the elevation beamwidth and/or reduce the magnitude of the grating lobes in the antenna beam formed by the radiating element. In still other embodiments, the slots in the conductive patch may extend from a center of the conductive patch outwardly, and may be closed off at the periphery of the metal patch. In yet other embodiments, four meandered traces may be used to electrically connect adjacent arms of the conductive patch near the periphery of the conductive patch.

Pursuant to still further embodiments of the present invention, techniques are provided for suppressing common mode resonances that the coaxial feed cables used to feed RF signals to the above-described radiator units may generate in the responses of other nearby radiating elements that operate in different operating frequency bands. Pursuant to these techniques, the outer conductor of each coaxial feed cable may be electrically connected to a common ground reference such as the reflector of the base station antenna at a location where the length of the RF transmission path that extends between the grounding location and the radiator unit may not be a length that is resonant in the operating frequency band of other nearby radiating elements that operate in different frequency bands. The length of each RF transmission path may be the length of the coaxial feed cable plus the length of any additional path between the end of the coaxial feed cable and the grounding location. Ideally, the length of the RF transmission path that extends between the grounding location and the radiator unit may be kept as short as possible in order to reduce insertion losses, but is also selected so that the electrical length of the monopole formed by the coaxial feed cable (and other RF transmission path to the grounding location) is not resonate in the operating frequency band of the other nearby radiating elements.

Pursuant to still further embodiments of the present invention, radiating elements are provided that include a conductive patch having first and second slots that each extend along a first axis and third and fourth slots that each extend along a second axis that is perpendicular to the first axis. These radiating elements also include a feed network that includes first through fourth feed lines, each feed line crossing a respective one of the first through fourth slots. The first and second feed lines are forward of a first major surface of the conductive patch and the third and fourth feed lines are rearward of a second major surface of the conductive patch.

In some embodiment, the conductive patch may be formed of sheet metal. The radiating element may also include a metal stalk that includes first and second air microstrip transmission lines. A signal trace of the first air microstrip transmission line and the first and second feed lines may be formed as a first monolithic feed structure, and a signal trace of the second air microstrip transmission line and the third and fourth feed lines may be formed as a second monolithic feed structure. The first monolithic feed structure may extend through an opening in the conductive patch, while the second monolithic feed structure does not extend through any opening in the conductive patch. In some embodiments, outer edges of the conductive patch are bent (e.g., upwardly and/or downwardly) at an angle of at least 30° with respect to an inner portion of the conductive patch.

The radiating elements according to embodiments of the present invention may have a number of advantages. First, the radiating elements may have small physical footprints, and hence may exhibit improved column-to-column isolation. Second, the radiating elements may be inexpensive to manufacture, and may require fewer soldered connections than many conventional radiating elements. The reduced number of solder joints may simplify assembly while also reducing the number of potential sources for passive intermodulation distortion. Additionally, the radiating elements may have very large operating frequency bands while meeting all necessary performance metrics.

Embodiments of the present invention will now be discussed in greater detail with reference to the accompanying figures.

Figure 1B:
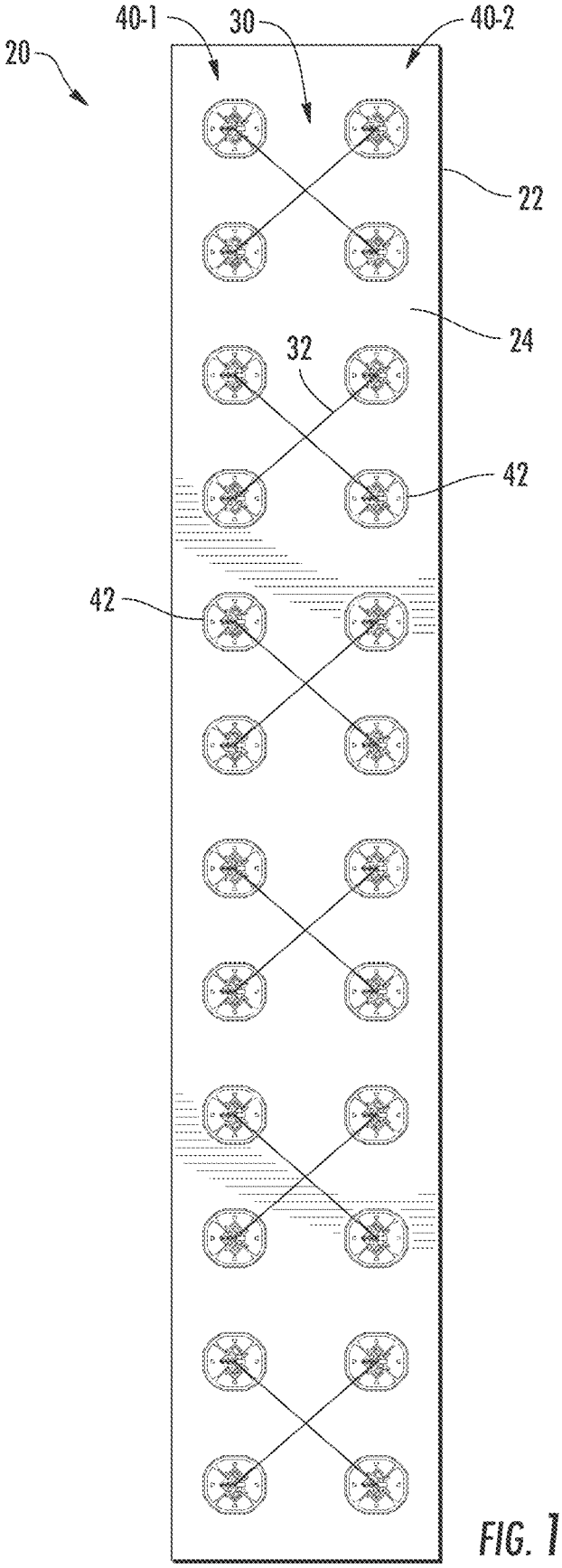
FIG. 1B is a schematic front view of the base station antenna of FIG. 1A with the radome removed.

FIGS. 1A and 1B illustrate a base station antenna 10 according to certain embodiments of the present invention. In particular, FIG. 1A is a front perspective view of the base station antenna 10, and FIG. 1B is a front view of the antenna 10 with the radome thereof removed to illustrate the inner components of the antenna. Any of the radiating elements according to embodiments of the present invention that are described herein may be used to implement the radiating elements (described below) in base station antenna 10.

As shown in FIG. 1A, the base station antenna 10 is an elongated structure that extends along a longitudinal axis L. The base station antenna 10 may have a tubular shape with a generally rectangular cross-section. The antenna 10 includes a radome 12 and a top end cap 14, which may or may not be integral with the radome 12. The antenna 10 also includes a bottom end cap 16 which includes a plurality of connectors 18 mounted therein. The antenna 10 is typically mounted in a vertical configuration (i.e., the longitudinal axis L may be generally perpendicular to a plane defined by the horizon when the antenna 10 is mounted for normal operation).

As shown in FIG. 1B, the base station antenna 10 includes an antenna assembly 20 that may be slidably inserted into the radome 12. The antenna assembly 20 includes a ground plane structure 22 that has a reflector 24. Various mechanical and electronic components of the antenna 10 may be mounted behind the reflector 24 such as, for example, phase shifters, remote electronic tilt ("RET") units, mechanical linkages, a controller, diplexers, and the like. The reflector 24 may comprise or include a metallic surface that serves as both a reflector and as a ground plane for the radiating elements of the antenna 10.

A plurality of dual-polarized low-band radiating elements 32 and a plurality of dual-polarized high-band radiating elements 42 are mounted to extend forwardly from the reflector 24. The low-band radiating elements 32 are mounted in a vertical column to form a linear array 30 of low-band radiating elements 32, and the high-band radiating elements 42 are mounted in two vertical columns to form two linear arrays 40-1, 40-2 of high-band radiating elements 42. The linear array 30 of low-band radiating elements 32 may be positioned between the two linear arrays 40-1, 40-2 of high-band radiating elements 42. Each linear array 30, 40-1, 40-2 may be used to form a pair of antenna beams, namely a first antenna beam having a+45° polarization and a second antenna beam having a−45° polarization. Note that herein when multiple like elements are provided, the elements may be identified by two-part reference numerals. The full reference numeral (e.g., linear array 40-2) may be used to refer to an individual element, while the first portion of the reference numeral (e.g., the linear arrays 40) may be used to refer to the elements collectively.

The low-band radiating elements 32 may be configured to transmit and receive signals in a first frequency band. In some embodiments, the first frequency band may comprise the 694-960 MHz frequency range or a portion thereof. The high-band radiating elements 42 may be configured to transmit and receive signals in a second frequency band. In some embodiments, the second frequency band may comprise the 1427-2690 MHz frequency range or a portion thereof. It will be appreciated that the number of linear arrays of radiating elements may be varied from what is shown in FIG. 1B, as may the number of radiating elements per linear array and/or the positions of the linear arrays. It will also be appreciated that multi-column arrays may be used instead of and/or in addition to the linear arrays of radiating elements.

As noted above, embodiments of the present invention provide low cost, high performance dual-polarized radiating elements that may be used, for example, to implement each of the high-band radiating elements 42 shown in FIG. 1B. A first embodiment of such a dual-polarized radiating element 100 will now be described with reference to FIGS. 2A-3C. The radiating element 100 may be used, for example, as each of the high-band radiating elements 42 in base station antenna 10 of FIGS. 1A-1B.

Figure 2A:
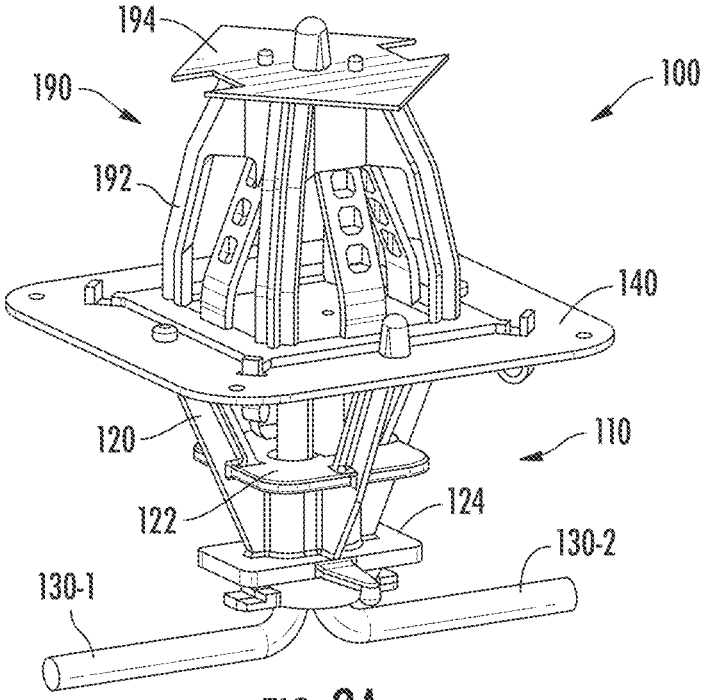
FIGS. 2A and 2B are a side perspective view and an exploded side perspective view, respectively, of a dual-polarized radiating element according to embodiments of the present invention.
Figure 2B:
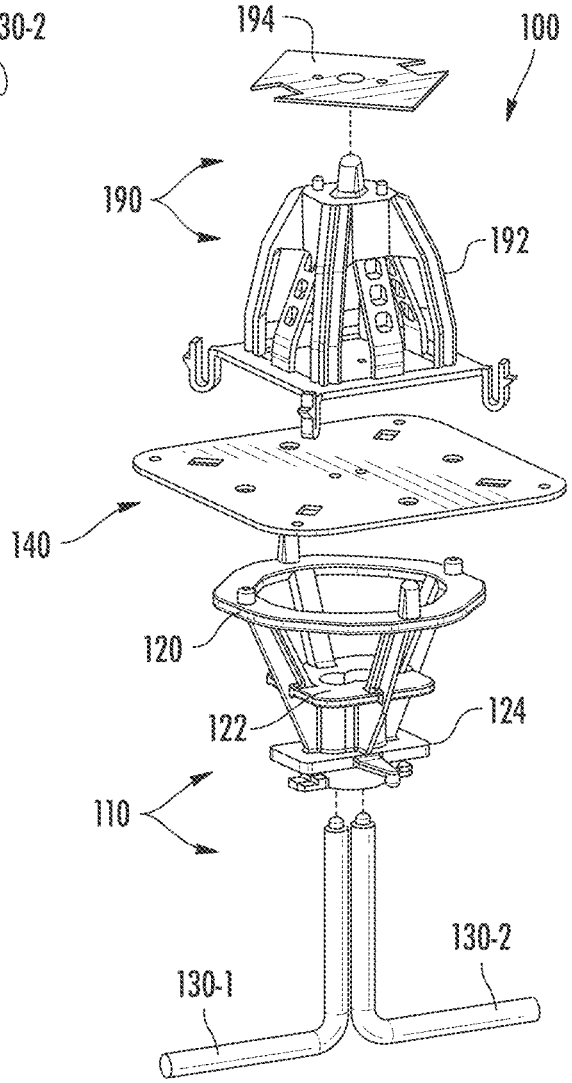

FIGS. 2A and 2B are a side perspective view and an exploded side perspective view, respectively, of a dual-polarized radiating element 100 according to embodiments of the present invention. As shown in FIGS. 2A-2B, the radiating element 100 includes a feed stalk 110, a radiator unit 140, and a director unit 190.

The feed stalk 110 may be used to mount the radiating element 100 to extend forwardly from the reflector 24 of base station antenna 10. The feed stalk 110 in the illustrated embodiment includes a support stalk 120 which may be made, for example, of plastic, and a pair of coaxial feed cables 130-1, 130-2. The radiator unit 140 may be mounted on the plastic support stalk 120 in some embodiments. The plastic support stalk 120 may include internal guide features 122 that are used to maintain the coaxial feed cables 130-1, 130-2 in their proper positions, as well as a mounting base 124 that is used to mount the plastic support stalk 120 in openings in the reflector 24 (FIG. 1B) so that the plastic support stalk 120 extends forwardly from the reflector 24. The coaxial feed cables 130-1, 130-2 may be routed from other components of the base station antenna 10 (e.g., from electromechanical phase shifter assemblies) that are mounted rearwardly of the reflector 24 to the opening in the reflector 24 in which the plastic support stalk 120 is mounted. The coaxial feed cables 130-1, 130-2 may extend through the opening and may be routed by the guide features 122 in the support stalk 120 to the radiator unit 140. The coaxial feed cables 130-1, 130-2 may be physically and/or electrically connected to the radiator unit 140. In particular, the outer conductors of the coaxial feed cables 130 may be electrically connected to a conductive patch (see FIG. 3A) of the radiator unit 140, while the center conductors of coaxial feed cables 130 may be coupled to a feed network (see FIG. 3A) of the radiator unit 140.

In order to increase the bandwidth of radiating element 100, the feed stalk 110 may be designed to mount the radiator unit 140 more than a quarter wavelength in front of the reflector 24 of base station antenna 100, where the wavelength refers to the wavelength corresponding to the center frequency of the operating frequency band of the radiating element 100.

While the support stalk 110 of FIGS. 2A-2B includes a plastic support 120 and a pair of coaxial feed cables 130-1, 130-2, it will be appreciated that the plastic support 120 may be omitted in other embodiments, and that the coaxial feed cables 130-1, 130-2 can be replaced with other feed structures (e.g., printed circuit board feeds, metal transmission line feeds, etc.) in still other embodiments.

The director unit 190 may comprise a director support 192 and a director 194. The director 194 may comprise, for example, a flat piece of metal that is somewhat smaller than a conductive patch that is included in the radiator unit 140. The director support 192 is used to mount the director 194 at a suitable height above the radiator unit 140. The director 194 may help narrow the radiation pattern of the radiating element 100 in both the azimuth and elevation planes.

The radiator unit 140 included in radiating element 100 will now be described with reference to FIGS. 3A-3C. It will be appreciated, however, that a wide variety of different radiator unit designs may be used. Examples of other radiator units that may be used in place of radiator unit 140 will be discussed below with reference to FIGS. 4A-4B and 6-11B.

Figure 3A:
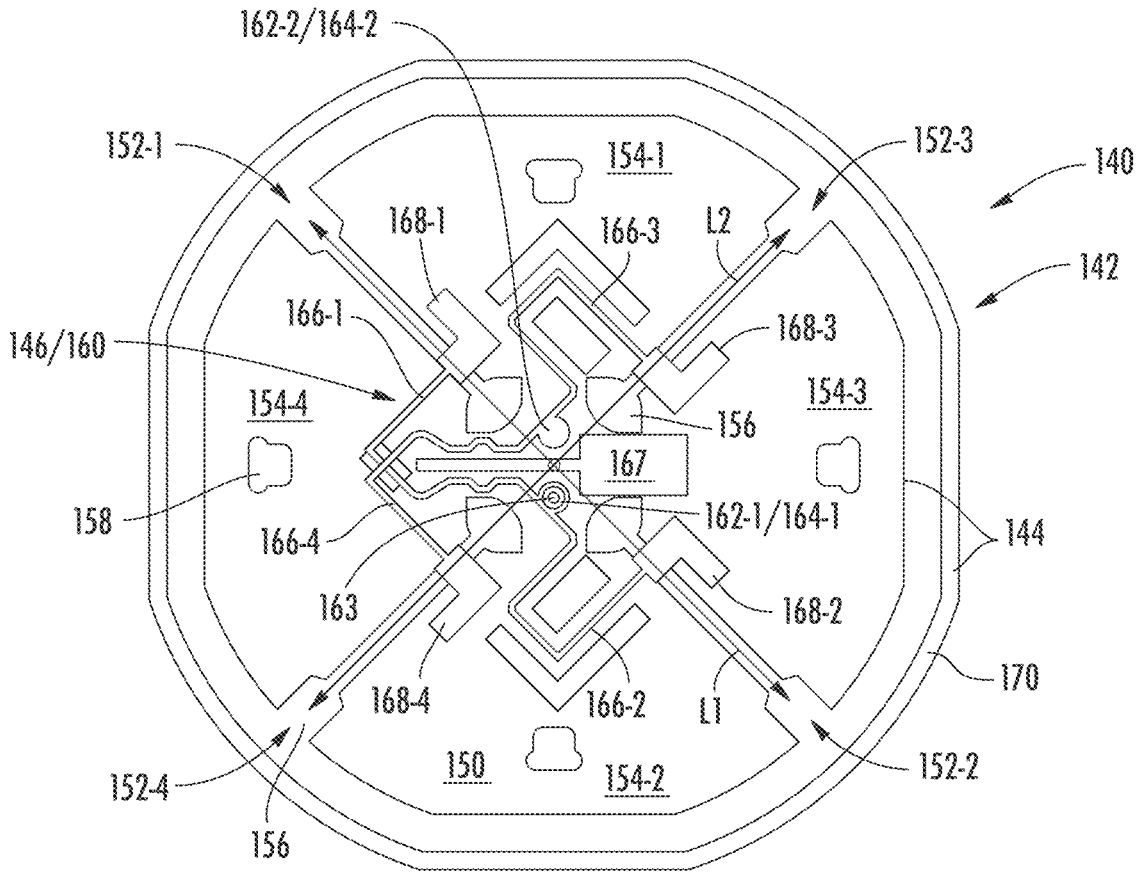
FIG. 3A is a front view of a radiator unit of the dual-polarized radiating element of FIGS. 2A-2B.
Figure 3B:
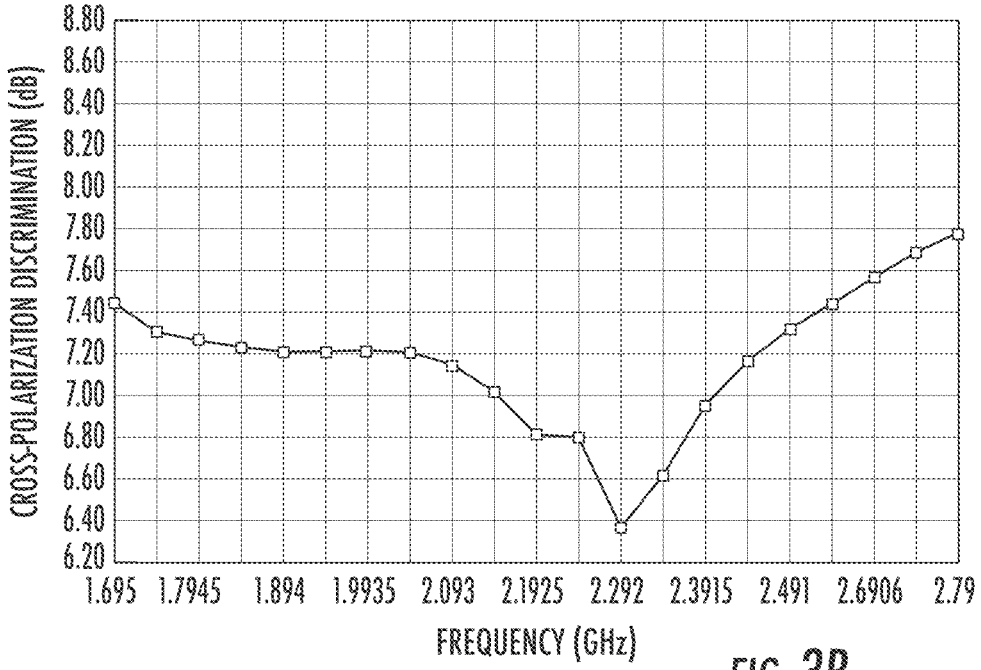
FIGS. 3B and 3C are graphs of the cross-polarization discrimination performance of the radiating element of FIG. 3A when implemented both without and with a conductive ring.
Figure 3C:
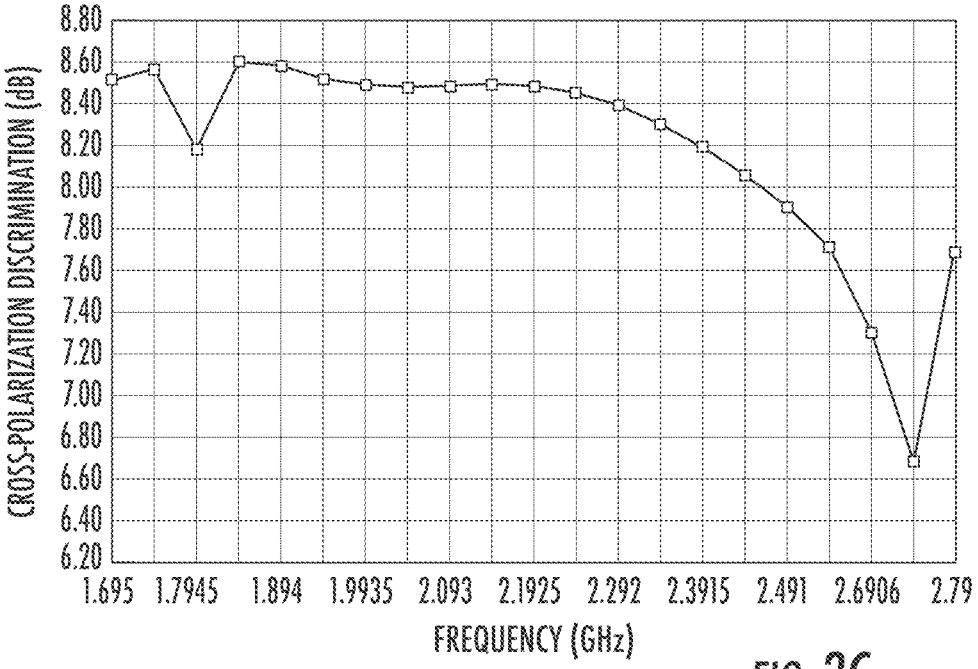

FIG. 3A is a front view of the radiator unit 140 of the dual-polarized radiating element 100 of FIGS. 2A-2B. The radiator unit 140 may be implemented using a printed circuit board 142 that has a first metallization layer 144 and a second metallization layer 146 that are separated by a dielectric layer 148. To simplify the drawing, the dielectric layer 148 is not shown in FIG. 3A (although suitable dielectric layers that could be used to implement dielectric layer 148 are shown, for example, in FIGS. 9A-10B), and the first and second metallization layers 144, 146 are depicted using different colors. In some embodiments, the first metallization layer 144 may be a rear metallization layer and the second metallization layer 146 may be a front metallization layer when the radiator unit 140 is implemented in a radiating element that is mounted in a base station antenna.

As shown in FIG. 3A, a conductive patch 150 may be formed in the first metallization layer 144. The conductive patch 150 may comprise a copper pattern that is formed on the rear of the dielectric layer 148 of the printed circuit board 142. Four slots 152-1 through 152-4 are formed in the conductive patch 150 where the metallization is omitted to expose the dielectric layer 148. Each slot 152 may extend radially from a respective point near the center of the conductive patch 150 to the periphery of the conductive patch 150. The slots 152 may divide the conductive patch 150 into four arms 154-1 through 154-4. Each slot 152 may be rotationally offset from adjacent slots by −90° and 90°, respectively. Thus, the first and second slots 152-1, 152-2 may extend along a first axis L1 and the third and fourth slots 152-3, 152-4 may extend along a second axis L2 that is perpendicular to the first axis L1. The first slot 152-1 may extend at an angle of −45°, the second slot 152-2 may extend at an angle of +135°, the third slot 152-3 may extend at an angle of +45°, and the fourth slot 152-4 may extend at an angle of −135°. Each of the first through fourth slots 152-1 through 152-4 may extend from a periphery of the conductive patch 150 towards the middle or "central region" of the conductive patch 150, and the four slots 152 may divide the conductive patch 150 into the four arms 154-1 through 154-4. Each arm 154 may be a generally pie-shaped wedge, and the four arms 154 may be electrically connected to each other in a central region of the conductive patch 150.

As shown in FIG. 3A, the width of each slot 152 may be expanded at one or both ends thereof to provide enlarged slot ends 156 in some embodiments. Additionally, some of the metallization (along with the underlying dielectric material of the printed circuit board 142) may be removed/omitted in, for example, central regions of some of the patch arms 154 to create openings 158. Legs of the director support 192 may be mounted in these openings 158.

The second metallization layer 146 of printed circuit board 142 may face forwardly, and may include a feed network 160 that is used to couple RF signals to and from the conductive patch 150. The feed network 160 may include first through fourth feed lines 166-1 through 166-4, where each feed line 166-1 through 166-4 crosses a respective one of the first through fourth slots 152-1 through 152-4. The feed lines 166 may be implemented as microstrip transmission lines in some embodiments. As shown in FIG. 3A, in other embodiments, metal pads 167 may be provided on one or both sides of some or all of the feed lines 166, and these metal pads 167 may be electrically connected to the underlying conductive patch 150 via plated through holes (not shown) that extend through the dielectric layer 148 of the printed circuit board 142. As the conductive patch 150 is connected to ground potential, the metal pads 167 may convert the feed lines 166 from microstrip transmission lines into coplanar waveguide transmission lines. It will also be appreciated that any other suitable type of feed line may be used including, for example, cables or strip lines or combinations of any of the above.

The feed network 160 may further include first and second inputs 162-1, 162-2 and first and second power dividers 164-1, 164-2. The inputs 162 may each comprise a metal pad. A hole 163 may extend through a center of each metal pad 162 and through the dielectric layer 148 of the printed circuit board 142 so that center conductors of the respective coaxial feed cables 130-1, 130-2 may be inserted through the printed circuit board 142 and through the respective metal pads 162-1, 162-2. The center conductors of coaxial feed cables 130-1, 130-2 may be soldered (or otherwise electrically connected) to the respective metal pads 162-1, 162-2. The outer conductors of coaxial feed cables 130-1, 130-2 may be soldered (or otherwise electrically connected) to the conductive patch 150. Each input pad 162-1, 162-2 may act as a respective power divider 164-1, 164-2 that splits an RF signal that is input to the respective input pads 162. Feed lines 166-1 and 166-2 extend from the two outputs of the first power divider 164-1 and cross the respective first and second slots 152-1, 152-2, and feed lines 166-3 and 166-4 extend from the two outputs of the second power divider 164-2 and cross the respective third and fourth slots 152-3, 152-4. In the depicted embodiment, each feed line 166-1 through 166-4 terminates into a respective one of four quarter wavelength stubs 168-1 through 168-4. As a result, RF signals that are input on feed lines 166-1 through 166-4 feed the respective slots 152-1 through 152-4. In particular, when feed lines 166-1 and 166-2 are excited, slots 152-1 and 152-2 are fed, causing the conductive patch 150 to radiate RF energy having a−45° polarization. Likewise, when feed lines 166-3 and 166-4 are excited, slots 152-3 and 152-3 are fed, causing the conductive patch 150 to radiate RF energy having a+45° polarization.

As is further shown in FIG. 3A, the radiator unit 140 may further include a conductive ring 170 that at least partially surrounds the periphery of the conductive patch 150 and that encloses each of the first through fourth slots 152-1 through 152-4. In the depicted embodiment, the conductive ring 170 is a thin, continuous metal ring that is implemented on the rear metallization layer 144 that completely surrounds the conductive patch 150. The conductive ring 170 may capacitively load the conductive patch 150. It has been found that this may improve the cross polarization discrimination performance of the radiating element 100. FIGS. 3B and 3C are graphs of the cross-polarization discrimination performance of radiating element 100 both with and without the conductive ring 170. As shown, without the ring (FIG. 3B), the cross-polarization discrimination is as low as 6.4 dB, whereas with the ring the cross-polarization discrimination is greater than 7.75 dB across the entire 1.695-2.690 GHz operating frequency band of the radiating element 100.

Figure 4A:
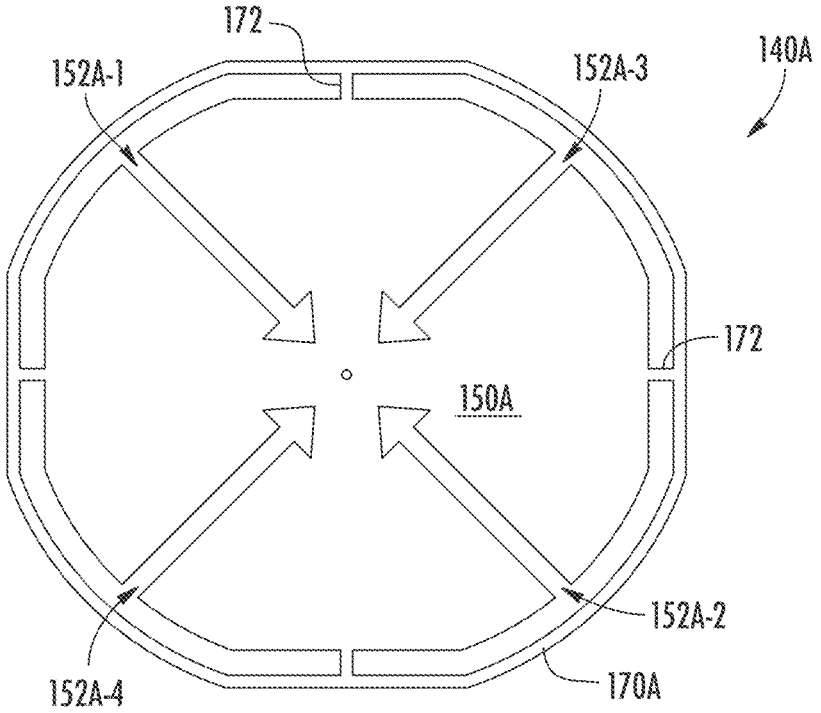
FIGS. 4A and 4B are front views of radiator units according to further embodiments of the present invention that may be used in place of the radiator unit of FIG. 3A.
Figure 4B:
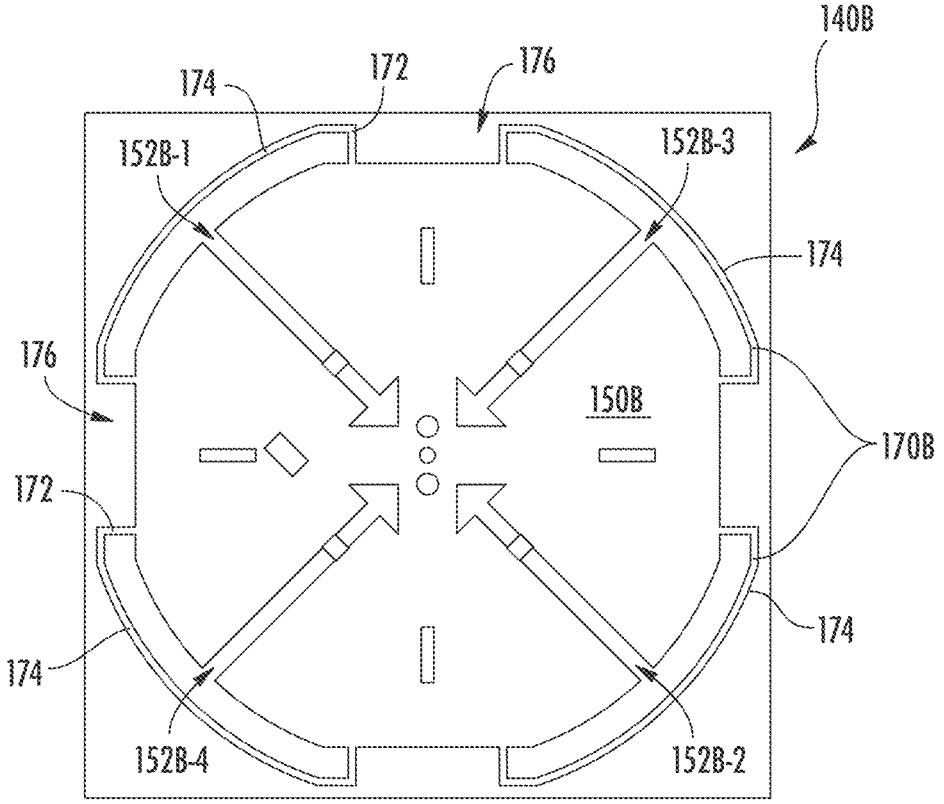

FIGS. 4A and 4B are front views of radiator units 140A, 140B, respectively, according to further embodiments of the present invention that may be used in place of the radiator unit 140 of FIG. 3A. FIGS. 4A and 4B only illustrate the conductive patch 150 and the conductive rings 170A, 170B and do not illustrate the feed network to simplify the drawings. It will be appreciated that the feed network 160 of FIG. 3A may be used as the feed networks for radiator unit 140A of FIG. 4A or for radiator unit 140B of FIG. 4B. The slots 152A, 152B in conductive patches 150A, 150B have slightly different designs from the slots 152 in conductive patch 150, and the mounting holes 158 are omitted in conductive patches 150A, 150B, but otherwise the conductive patches 150, 150A and 150B are identical.

As shown in FIG. 4A, the conductive ring 170A of radiator unit 140A is identical to conductive ring 170, except that four tabs 172 are provided that electrically short the conductive ring 170A to the conductive patch 150A. As a result, the conductive ring 170A is maintained at ground potential and is not electrically floating as is the conductive ring 170 of FIG. 3A. As shown in FIG. 4B, the conductive ring 170B is similar to the conductive ring 170A, but is a discontinuous ring that includes four segments 174 that are separated by gaps 176. Each segment 174 is electrically connected to the conductive patch 150B by a pair of tabs 172.

Figure 5A:
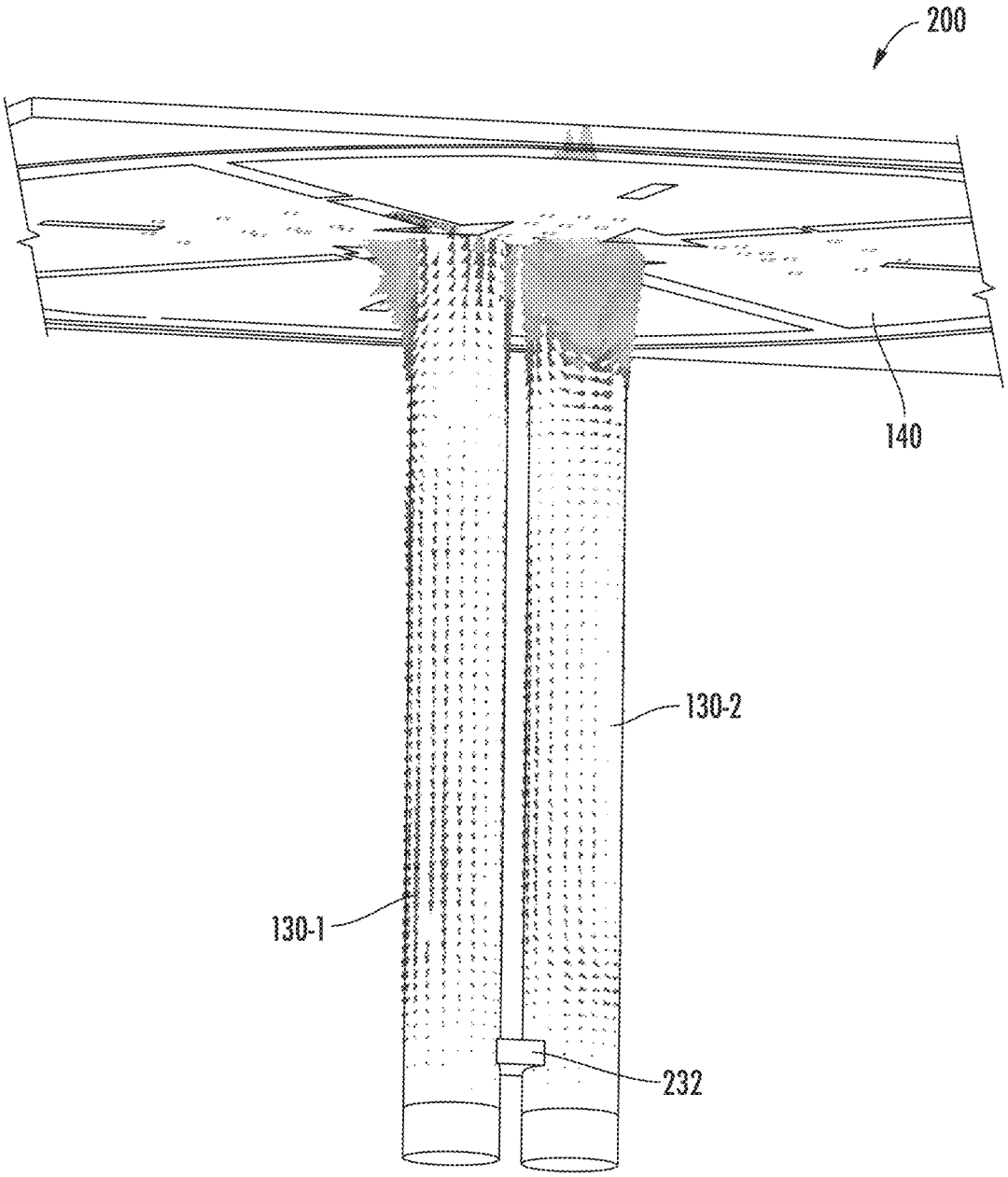
FIG. 5A is a perspective rear view of a radiating element according to further embodiments of the present invention in which the outer conductors of the feed coaxial cables are soldered together.

FIG. 5A is a perspective rear view of a radiating element 200 according to further embodiments of the present invention in which the outer conductors of the feed coaxial cables are electrically connected to each other by a conductive stub.

The radiating element 200 may be identical to the radiating element 100 discussed above with one exception, which is that the outer conductors of coaxial feed cables 130-1, 130-2 are electrically connected together by a conductive stub 232 in radiating element 200. Note that various features of radiating element 200 are not shown in FIG. 5A, such as the stalk support 120 of the director unit 190.

The outer conductors of each coaxial feeder cable 130-1, 130-2 are nominally at ground potential. However, the coaxial feed cables 130-1, 130-2 may not connect to a common ground in the vicinity of radiating element 200 and, as a result, the two outer conductors may not actually be at a common potential. This difference in potential may result in unbalanced currents flowing on the coaxial feed cables 130-1, 130-2, which may degrade both the port-to-port isolation and the cross-polarization antenna pattern performance of the radiating element. As discussed above, the radiator unit 140 may be mounted more than a quarter wavelength in front of the reflector 24. This may result in unbalanced currents flowing in the coaxial feed cables 130-1, 130-2. In order to balance the currents, a conductive stub 232 is used to physically and electrically connect the outer conductors of the coaxial feed cables 130-1, 130-2. In some embodiments, the conductive stub 232 may comprise a solder joint. In other embodiments, the conductive stub 232 may comprise a conductive element that is soldered or otherwise connected to the outer conductors of the coaxial feed cables 130-1, 130-2. In some embodiments, the conductive stub 232 may be positioned about one quarter wavelength from the radiating unit 140.

Figure 5B:
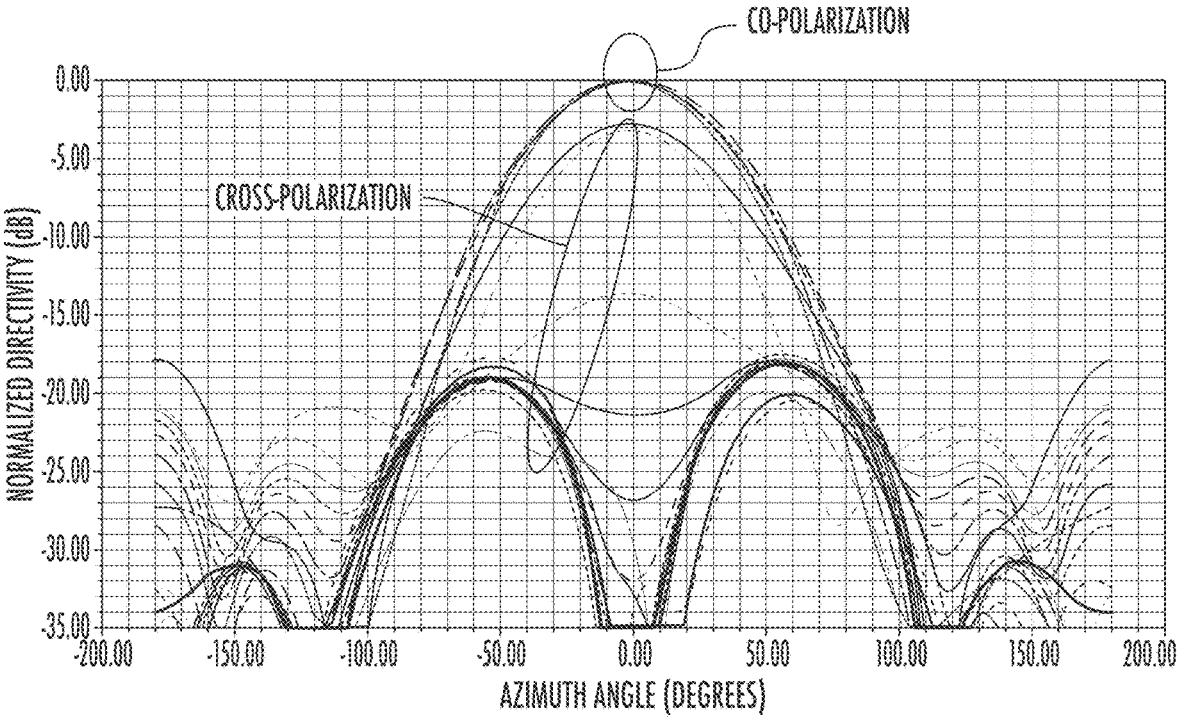
FIGS. 5B and 5C are simulated azimuth patterns for the radiating element of FIG. 5A without and with the conductive stubs, respectively.
Figure 5C:
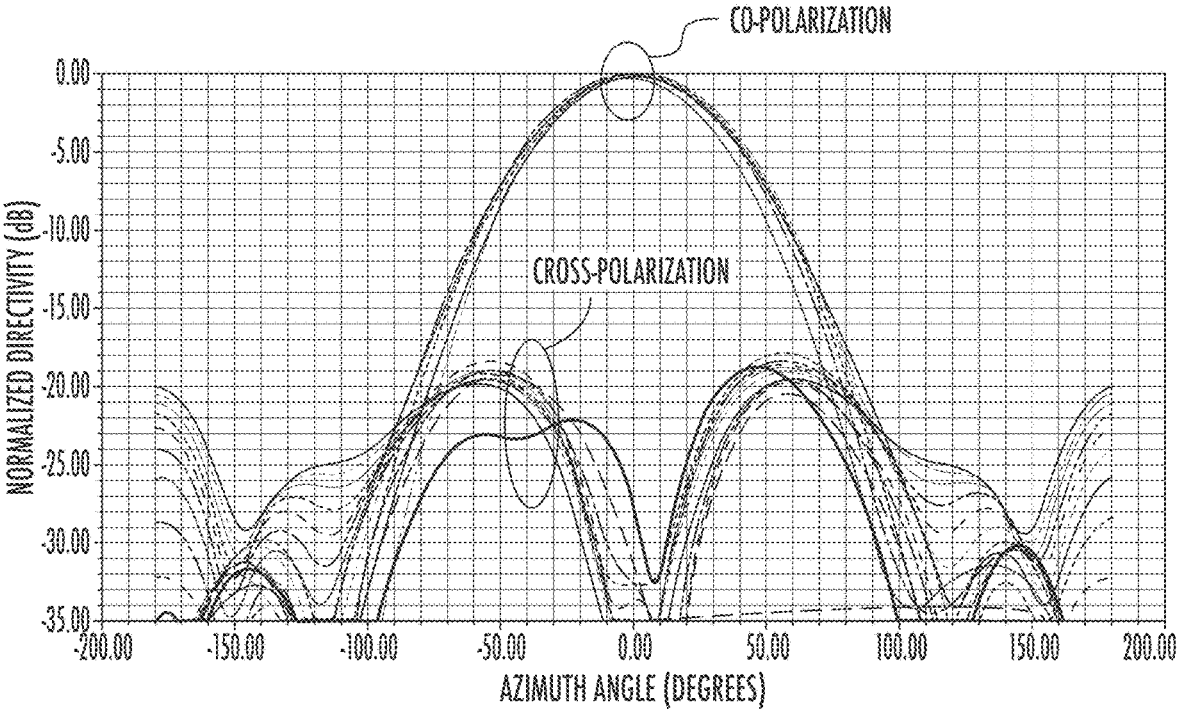

FIGS. 5B and 5C illustrate the impact of the conductive stub 232 on the antenna patterns of radiating element 200. The "co-polarization" and "cross-polarization" antenna patterns are shown in each graph, with the different curves representing the performance at different frequencies across the operating frequency band of radiating element 200. The co-polarization curves show the power as a function of azimuth angle that is emitted by the radiating element at the intended polarization. The cross-polarization curves show the power as a function of azimuth angle that is emitted by the radiating element at the other polarization.

As shown in FIG. 5B, which depicts the simulated co-polarization and cross-polarization azimuth patterns for the radiating element 200 if the conductive stub is not included, very high levels of cross-polarized signal are present in the pattern at the two lowest frequencies measured (both of which were near 1700 MHz). This level of cross-polarized signal in the pattern is not acceptable. As shown in FIG. 5C, which is a corresponding graph for radiating element 200 when conductive stub 232 is included, the cross-polarization levels are significantly reduced and acceptable azimuth patterns are achieved.

Figure 5D:
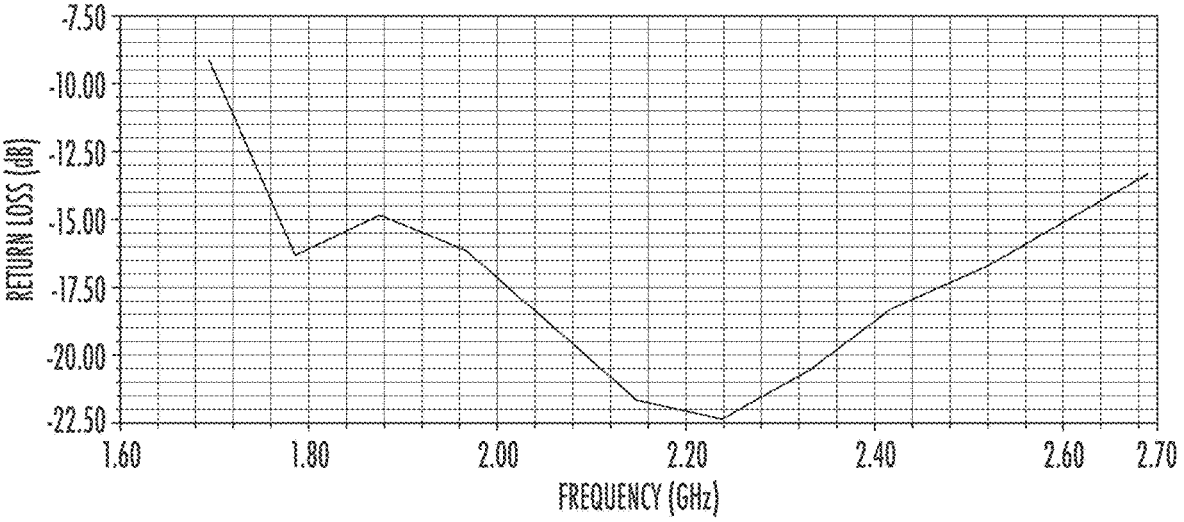
FIGS. 5D and 5E are graphs showing the simulated return loss for the radiating element of FIG. 5A without and with the conductive stubs, respectively.
Figure 5E:
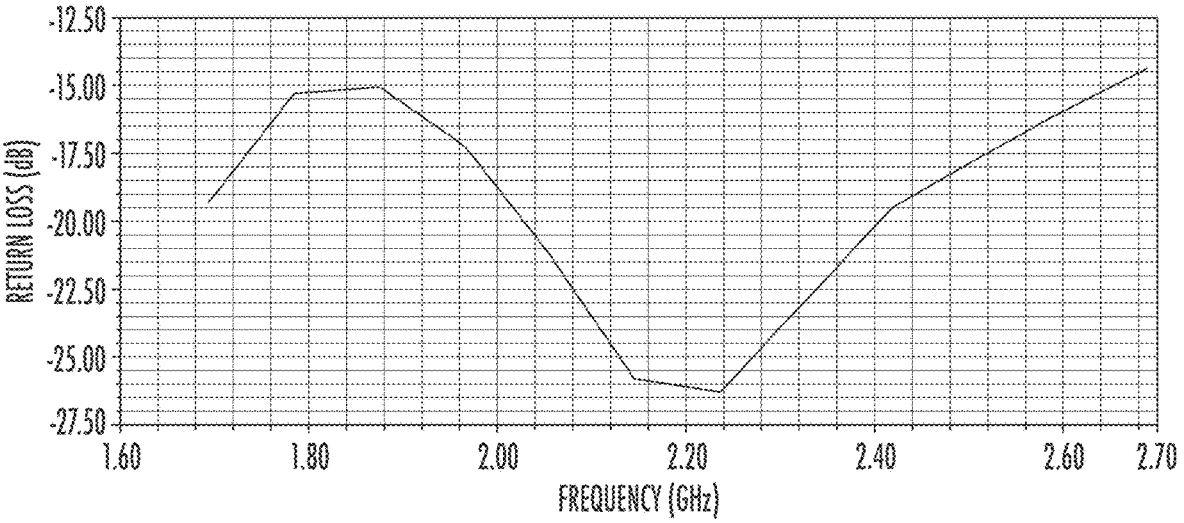
Figure 5F:
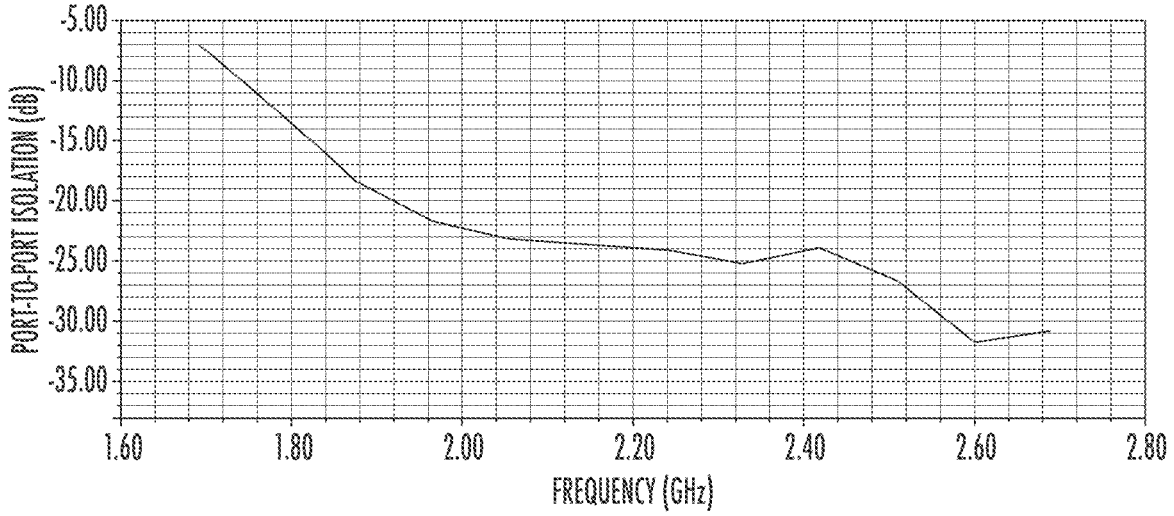
FIGS. 5F and 5G are graphs showing the simulated port-to-port isolation for the radiating element of FIG. 5A without and with the conductive stubs, respectively.
Figure 5G:
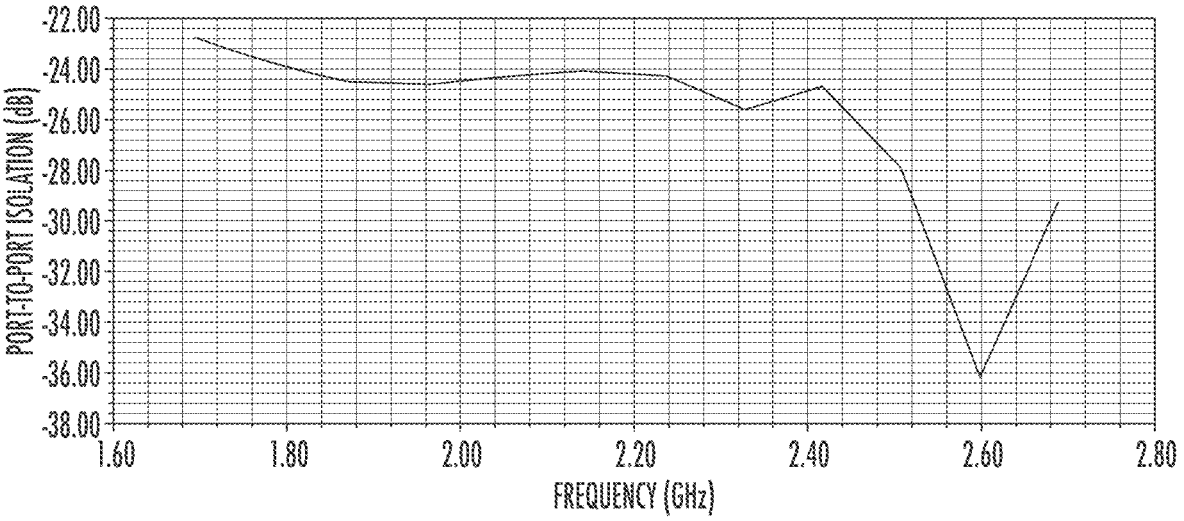

FIGS. 5D and 5E illustrate the return loss as a function of frequency for radiating element 200 without (FIG. 5D) and with (FIG. 5E) the conductive stub 232 across the 1.695-2.690 GHz operating frequency band of the radiating element. As shown in FIG. 5D, without conductive stub 232, unacceptably high levels of return loss (more than −10 dB) are seen at the lower edge of the operating frequency band. In contrast, FIG. 5E shows that when the conductive stub 232 is added the return loss is below −13 dB across the entire operating frequency band. FIG. 5F (without stub 232) and FIG. 5G (with sub 232) show that adding the conductive stub 232 also provides significant improvement in port-to-port isolation.

Figure 6:
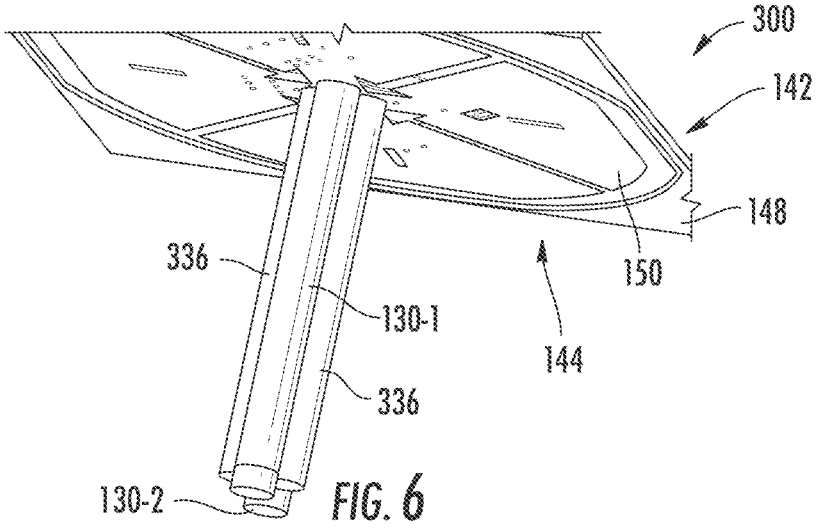
FIG. 6 is a perspective rear view of a radiating element according to still further embodiments of the present invention that includes a pair of metal rods that are soldered to the feed cables.

FIG. 6 is a rear perspective view of a radiating element 300 according to still further embodiments of the present invention that includes a pair of metal tubes 336 that are mounted beside the pair of coaxial feed cables 130-1, 130-2. The radiating element 300 may be identical to the radiating element 100 discussed above with one exception, which is that two conductive tubes 336 are mounted adjacent the outer conductors of the coaxial feed cables 130-1, 130-2. Note that various features of radiating element 300 are not shown in FIG. 6, such as the stalk support 120 of the director unit 190. The tubes 336 may increase the port-to-port isolation of the radiating element 300. The tubes 336 may be hollow metal tubes, solid metal tubes or coaxial cables in example embodiments. The addition of the tubes 336 balances the current on all four arms of the radiating element 300.

Figure 7:
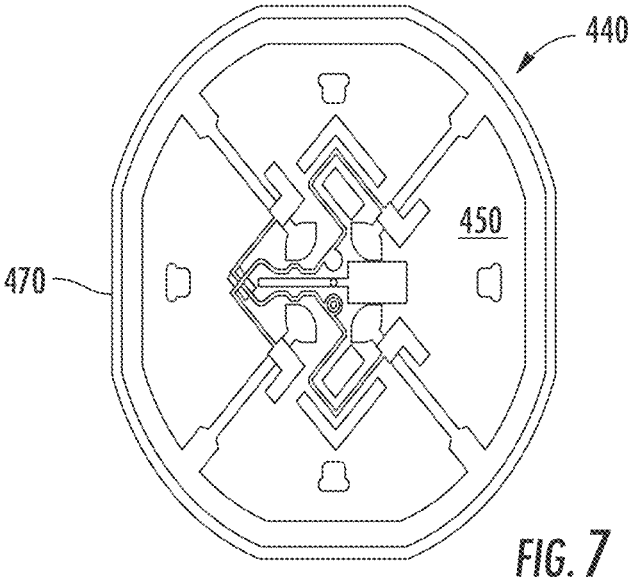
FIG. 7 is a front view of a radiator unit according to further embodiments of the present invention.

FIG. 7 is a front view of a radiator unit 440 according to further embodiments of the present invention. The radiator unit 440 can be used, for example, in the radiating element 100 of FIGS. 2A-2B. As shown in FIG. 7, the radiator unit 440 has an aspect ratio (defined here as the ratio of width to height when the radiating element including radiator unit 440 is mounted for normal use) that is less than one. This occurs because both the conductive patch 450 and the conductive ring 470 are elongated in the vertical direction.

By elongating the radiator unit 440 in the vertical direction, the distance between adjacent elements in a column of radiating elements may be reduced. This may help reduce the magnitude of grating lobes, which refer to sidelobes in the elevation pattern (and in particular at high elevation angles) that are in undesired directions. The azimuth pattern for a radiating element that includes radiator unit 440 may generally be the same as the azimuth pattern for a radiating element that includes radiator unit 110, while the beamwidth of the main lobe in the elevation pattern for the radiating element that includes radiator unit 440 may be reduced. The improvements in elevation beamwidth and grating lobe reduction, however, have to be balanced against an expected degradation in port-to-port isolation.

Figure 8:
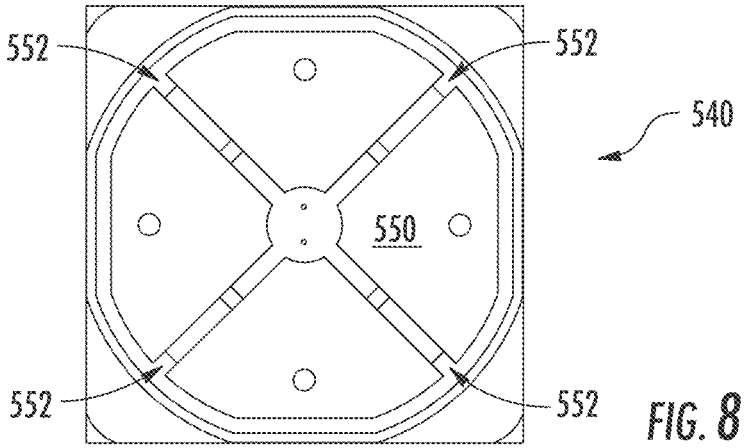
FIG. 8 is a front view of a radiator unit according to still further embodiments of the present invention.

FIG. 8 is a front view of a radiator unit 540 according to still further embodiments of the present invention. The radiator unit 540 is similar to the radiator unit 140 of FIG. 3A, but differs in that the slots 552 extend all the way to the center of the conductive patch 550, and the slots no longer extend to the periphery of the conductive patch 550. The radiator unit 540 may generate similar antenna patterns as those generated by radiator unit 140, and may also exhibit similar return loss performance. One potential difficulty with radiator unit 540 is that the center of the conductive patch 550 is not metallized, and hence there is not a convenient place to connect the coaxial feed cables 130-1, 130-2 to the conductive patch 550, and the transmission lines of the feed network that are in the center of the printed circuit board do not have a ground plane on the opposite side of the dielectric. Additionally, if the coaxial feed cables are mounted in the center of the conductive patch 550, the outer conductors may negatively impact the operation of the conductive patch 550. Thus, different feed structures (not shown) such as feed cables may be used to feed the slots 552 of conductive patch 550.

Figure 9A:
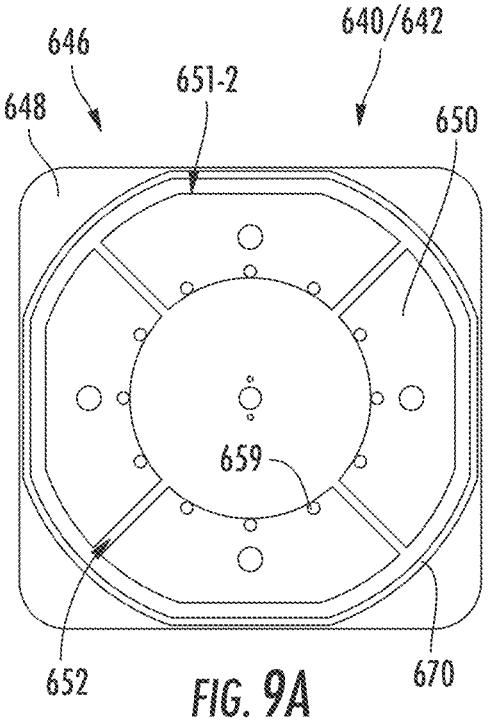
FIGS. 9A and 9B are a front view and a back view, respectively, of a radiator unit printed circuit board according to further embodiments of the present invention with the feed network of the radiator unit omitted.
Figure 9B:
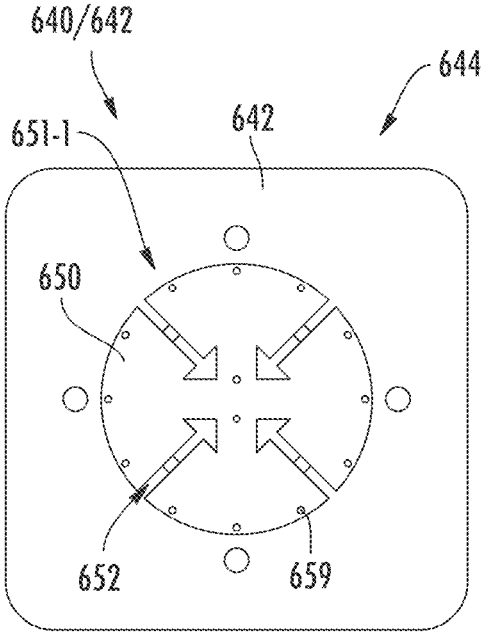

FIGS. 9A and 9B are a front view and a back view, respectively, of a radiator unit 640 (which is implemented using a printed circuit board 642) according to further embodiments of the present invention, with the feed network of the radiator unit 640 omitted. The radiator unit 640 includes a conductive patch 650 that is implemented on two different metallization layers of the printed circuit board 642. In particular, a first portion 651-1 of the conductive patch 650 is implemented on a rear metallization layer 644 of the printed circuit board 642, while a second portion 651-2 of the conductive patch 650 is implemented on a front metallization layer 646 of the printed circuit board 642. The first portion 651-1 comprises the central portion of the conductive patch 650 and has four slots 652 therein while the second portion 651-2 comprises an outer portion of the conductive patch 650 and has an annular shape with the four slots 652 therein. The outer portion 651-2 overlaps the central portion 651-1. In the depicted embodiment, plated through holes 659 are used to electrically connect the two portions 651 of conductive patch 650 together. In other embodiments, capacitive coupling may be used through the dielectric layer 648 of printed circuit board 642.

A conductive ring 670 surrounds the outer portion 651-2 of the conductive patch 650. The conductive ring 670 is formed on the front metallization layer 646 of the printed circuit board 642 in the depicted embodiment, although it may be formed on rear metallization layer 644 in other embodiments. The feed network for radiator unit 640, which is not shown in FIGS. 9A-9B to simplify the drawings, may be identical (or at least substantially similar) to the feed network 160 for radiator unit 140, and may be formed on the front metallization layer 646 of printed circuit board 642 in the interior of the annular second portion 651-2 of the conductive patch 650.

Figure 10A:
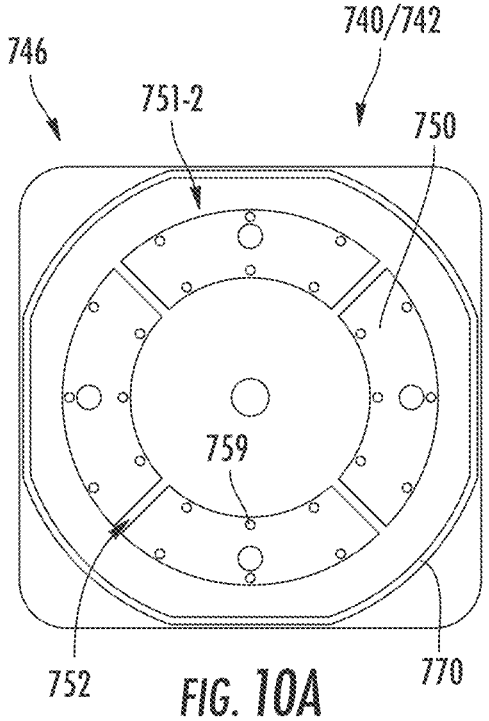
FIGS. 10A and 10B are a front view and a back view, respectively, of a radiator unit printed circuit board according to still further embodiments of the present invention with the feed network omitted.
Figure 10B:
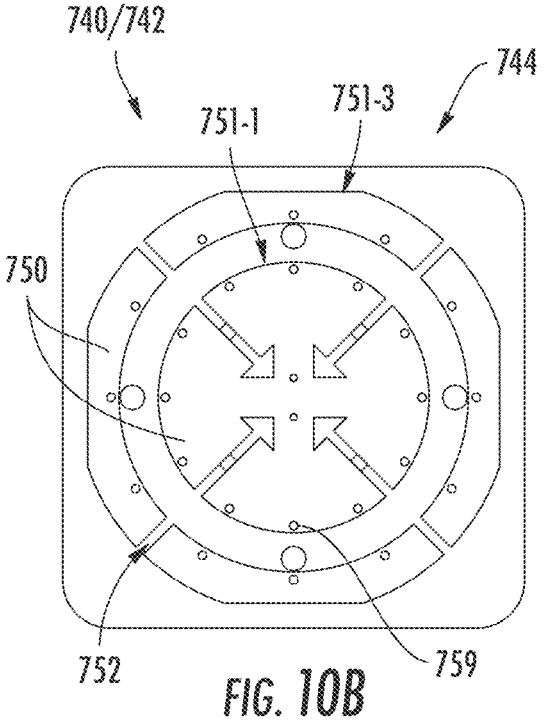

FIGS. 10A and 10B are a front view and a back view, respectively, of a radiator unit 740 (which is implemented using a printed circuit board 742) according to still further embodiments of the present invention, with the feed network omitted. The radiator unit 740 includes a conductive patch 750 that is implemented on two different layers of the printed circuit board 742, but in this case, the conductive patch 750 has three separate portions. The first and third portions 751-1, 751-3 of the conductive patch 750 are implemented on a rear metallization layer 744 of the printed circuit board 742, while the second portion 751-2 is implemented on a front metallization layer 746 of the printed circuit board 742. The first portion 751-1 comprises the central portion of the conductive patch 750 and has four slots 752 therein, the second portion comprises a middle portion 751-2 and has an annular shape with four slots 752 therein, and the third portion comprises an outer portion 751-3 and also has an annular shape with four slots 752 therein. The middle portion 751-2 overlaps both the central portion 751-1 and the outer portion 751-3. In the depicted embodiment, plated through holes 759 are used to electrically connect the three portions 751 of conductive patch 750 together. In other embodiments, capacitive coupling may be used through the dielectric layer of the printed circuit board 742.

A conductive ring 770 surrounds the middle portion 751-2 of the conductive patch 750. The conductive ring 770 is formed on the front metallization layer 746 of the printed circuit board 742 in the depicted embodiment, although it may be formed on rear metallization layer 744 in other embodiments. The feed network for radiator unit 740, which is not shown in FIGS. 10A-10B to simplify the drawings, may be identical (or at least substantially similar) to the feed network 160 for radiator unit 140, and may be formed on the front metallization layer 746 of printed circuit board 742 in the interior of the annular second portion 751-2 of the conductive patch 750.

Figure 11A:
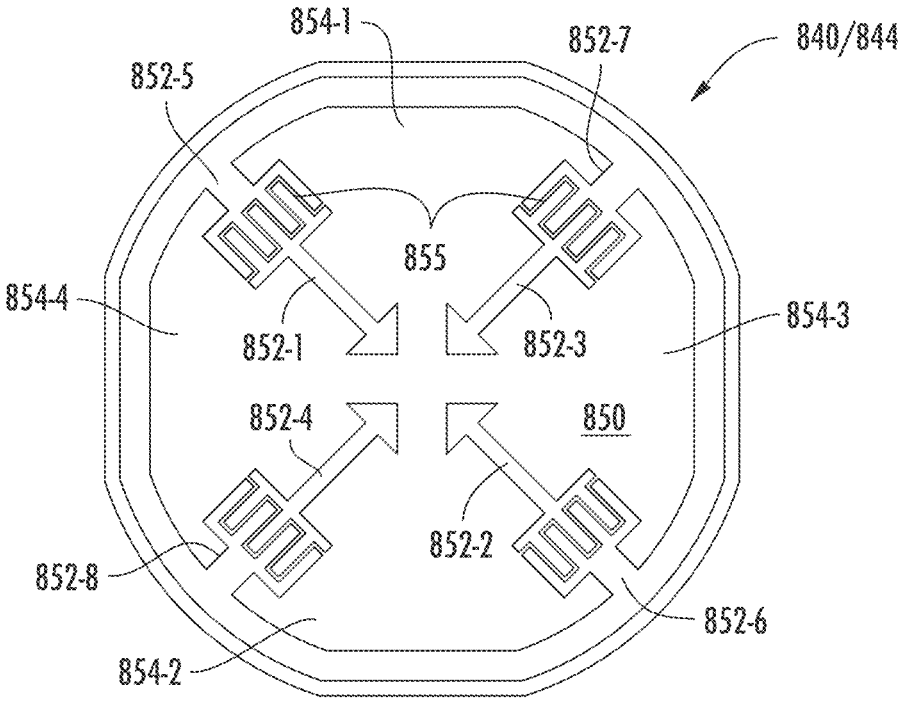
FIGS. 11A and 11B are a front view and a back view, respectively, of a radiator unit printed circuit board according to yet additional embodiments of the present invention with the feed network of the radiator unit omitted.
Figure 11B:
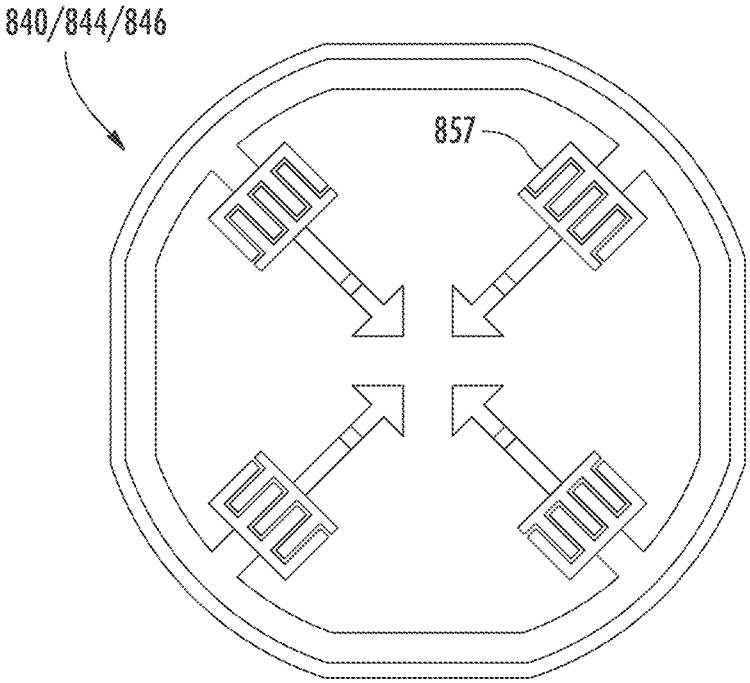

FIGS. 11A and 11B are a front view and a back view, respectively, of a radiator unit 840 (which is implemented using a printed circuit board) according to still further embodiments of the present invention, with the feed network again omitted. Radiator unit 840 is similar to radiator unit 140 discussed above, except that adjacent arms 854 of radiator unit 840 are electrically connected to each other by meandered traces 855 near the periphery of the conductive patch 850. As a result, the conductive patch 850 includes a total of eight slots therein, namely four inner slots 852-1 through 852-4 and four outer slots 852-5 through 852-8. As shown in FIG. 11B, on the front metallization layer 846 of the printed circuit board, four metal pads 857 are provided that overlap the meandered traces 855. As a result, the combination of a meandered trace 855 and its corresponding overlapping metal pad 857 acts like a filtered connection between the two adjacent arms 854.

It will be appreciated that the above-described radiating elements according to embodiments of the present invention may be combined in any way to provide many additional embodiments. For example, the conductive stub 232 of radiating element 200 and/or the conductive tubes 336 of radiating element 300 may be included in any of the other radiating elements described herein. Similarly, the conductive ring structures of FIG. 4A or 4B may be used to replace the conductive rings of any of the other embodiments, or the conductive ring may be omitted in its entirety. Any of the radiator units described herein may be elongated vertically like the radiator unit 440 of FIG. 7, and/or the slot design for any of the conductive patches may be modified to have the slot design of the conductive patch 550 of FIG. 8. Additionally, any of the conductive patches may be implemented as multi-layer conductive patches as shown in FIGS. 9A-10B, or may include the filters that are provided in the conductive patch 850 of FIGS. 11A-11B. All such embodiments are considered to be within the scope of the present invention. It will also be appreciated that this specification only describes a few example embodiments, and that many changes may be made thereto without departing from the scope of the present invention.

Figure 12A:
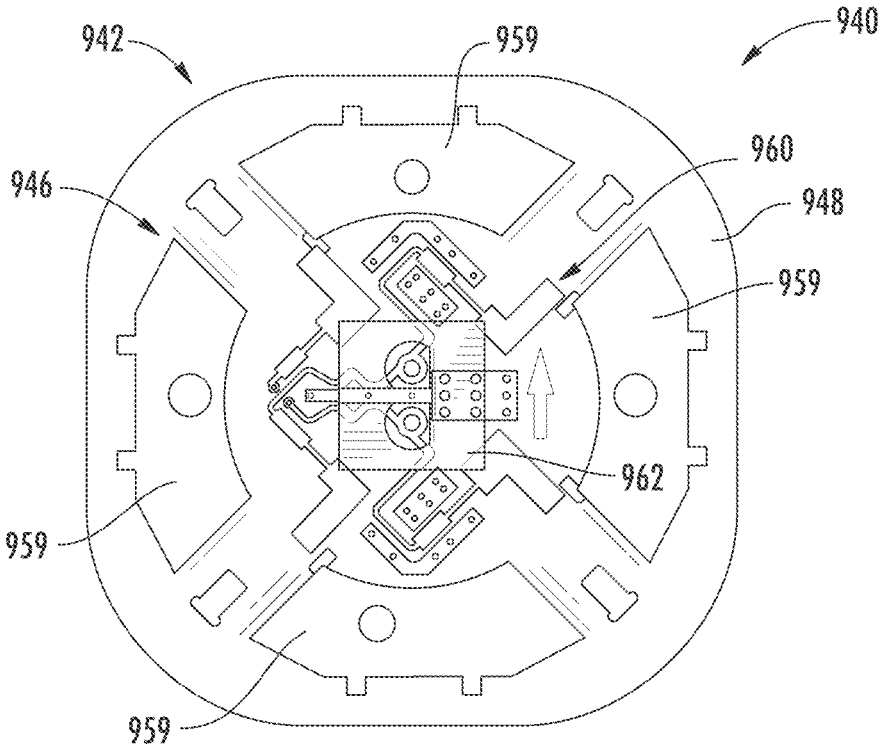
FIGS. 12A and 12B are a front view and a back view, respectively, of a radiator unit printed circuit board according to yet additional embodiments of the present invention.
Figure 12B:
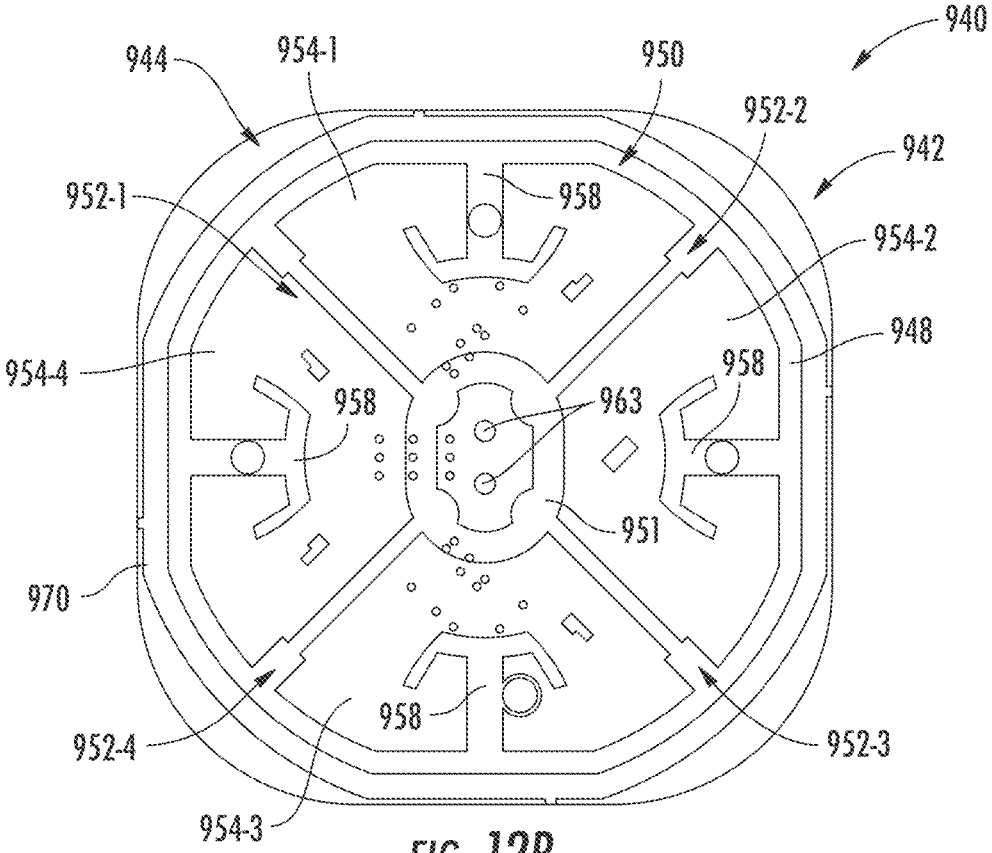

FIGS. 12A and 12B are front and rear views, respectively, of another alternative radiator unit 940 that may be used in place of the radiator unit 140 of the dual-polarized radiating element 100 of FIGS. 2A-2B. The radiator unit 940 may comprise a printed circuit board 942 that has a first metallization layer 944 and a second metallization layer 946 that are separated by a dielectric layer 948. In the depicted embodiment, the first metallization layer 944 is the rear metallization layer (FIG. 12B) and the second metallization layer 946 is the front metallization layer (FIG. 12A).

Similar to the radiator unit 140 discussed above with reference to FIG. 3A, the radiator unit 940 includes a conductive patch 950 that is implemented in the rear metallization layer 944 of printed circuit board 942. Four radial slots 952-1 through 952-4 are formed in conductive patch 950, with each slot 952 extending outwardly from near the center of the conductive patch 950. Each slot 952 comprises a region where the rear layer metallization is omitted (or removed) to expose the dielectric layer 948 of printed circuit board 942. Each slot 952 may be rotationally offset from adjacent slots 952 by −90° and 90°, respectively. As shown in FIG. 12B, the four slots 952 divide the conductive patch 950 into four arms 954-1 through 954-4. Each arm 954 of the conductive patch 950 has a generally T-shaped region where the metallization is omitted to form respective openings 958, which extend inwardly from the outer edge of the respective arms 954. The four arms 954 connect to each other in the central region of the conductive patch 950. A conductive ring 970 surrounds the conductive patch 950. The conductive ring 970 is formed on the rear metallization layer 944 in the depicted embodiment, although it may be formed on front metallization layer 944 in other embodiments. The conductive ring 970 may be identical to the conductive ring 170 of radiator unit 140. In other embodiments, part of the conductive ring 970 may be formed in the front metallization layer 946 and the remainder may be formed in the rear metallization layer 944.

The outer conductors of the two feed cables 130-1, 130-2 (FIGS. 2A-2B) may be soldered to the conductive patch 950 in the central region of conductive patch 950. A ring-shaped (annular) solder mask 951 may be formed on the conductive patch 950 as shown in FIG. 12B. The conductive patch 950 includes a pair of central openings 963 that receive the center conductors of the feed cables 130-1, 130-2 so that the center conductors may pass through the dielectric substrate 948 to be electrically connected to a feed network 960 that is formed in the front metallization layer 946. The center conductors of the two feed cables 130-1, 130-2 are electrically isolated from the conductive patch 950.

Referring to FIG. 12A, the front metallization layer 946 of printed circuit board 942 includes the feed network 960, which is used to couple RF signals to and from the conductive patch 950. The feed network 960 may be similar to or identical to the feed network 160 discussed above with reference to FIG. 3A, and hence further description thereof will be omitted here. A solder mask 962 may be formed on the central region of the feed network 960 to facilitate soldering the central conductors of the feed cables 130-1, 130-2 to the inputs of the feed network 960. As is shown in FIG. 12A, the front metallization layer 946 may further include four conductive plates 959 that together form a broken annular ring. The broken annular ring may generally surround the feed network 960. Each conductive plate 959 may overlap a respective one of the T-shaped openings 958 in the arms 954 of the conductive patch 950. The conductive plates 959 may capacitively couple with the underlying conductive patch 950.

Figure 13A:
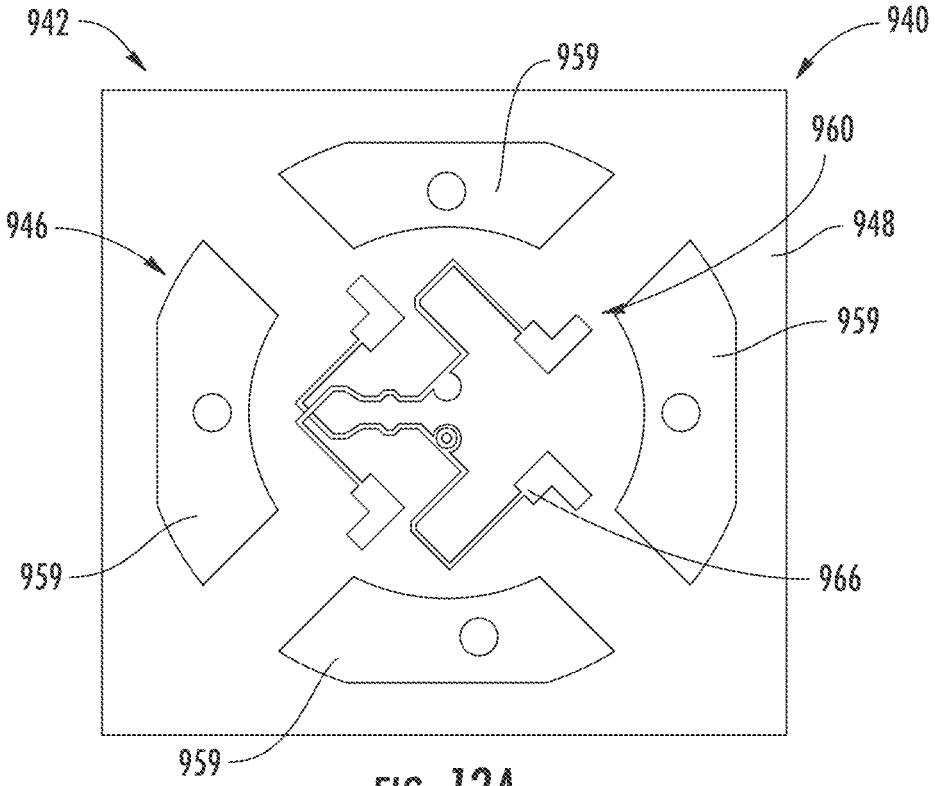
FIGS. 13A and 13B are shadow front and back views, respectively, of the radiator unit printed circuit board of FIGS. 12A and 12B.
Figure 13B:
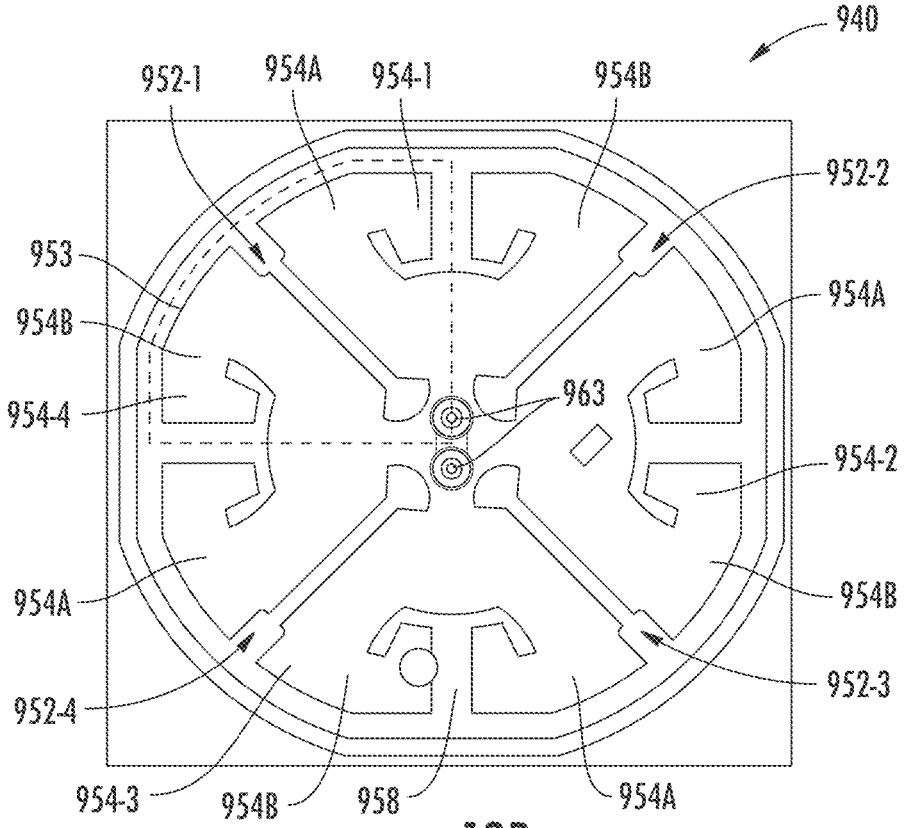

FIGS. 13A and 13B are shadow front and back views, respectively, of the radiator unit printed circuit board 942 of FIGS. 12A and 12B. The solder masks 951, 962 that are shown in the middle of FIGS. 12A-12B are omitted in FIGS. 13A-13B to better illustrate the rear and front metallization layers 944, 946.

The radiator unit 940 of FIGS. 12A-13B may have the general design of the radiator unit disclosed in FIGS. 7-8of U.S. Pat. No. 7,688,271. In particular, referring to FIGS. 13A-13B, it can be seen that each arm 954 of conductive patch 950 includes a first half 954A and a second half 954B that comprise respective first and second legs 954A, 954B that extend radially outwardly from the central region of the printed circuit board 942. Each pair of a first leg 954A of a first arm 954 and an adjacent second leg 954B of an adjacent second arm 954 together form a generally T-shaped dipole radiator 953, as can be seen in the dashed box in FIG. 13B. Each slot 952 separates the first and second legs 954A, 954B of a respective one of the dipole radiators 953. The four dipole radiators 953 form a dipole square that has a generally octagonal profile. As with the radiator unit disclosed in FIGS. 7-8 of U.S. Pat. No. 7,688,271, each dipole radiator 953 is fed by a respective hook shaped feed line 966 that crosses the respective slot 952 of the dipole radiator 953 on the opposite side of the printed circuit board 942.

There are several differences between the radiator unit disclosed in FIGS. 7-8 of U.S. Pat. No. 7,688,271 and the radiator unit 940 of FIGS. 12A-13B. For example, in radiator unit 940, the feed network 960 is implemented on the front metallization layer 946 and the dipole radiators 953 are implemented on the rear metallization layer 944, which is the reverse of what is shown in U.S. Pat. No. 7,688,271. As another example, in U.S. Pat. No. 7,688,271 the openings in each arm of the conductive patch where the metallization is removed are generally diamond-shaped as compared to the generally T-shaped openings 958 included in the arms 954 of radiator unit 940. As another example, the radiator unit 940 includes the conductive plates 959 that are formed on the front metallization layer 944, which are not provided in the radiator unit of U.S. Pat. No. 7,688,271. Additionally, U.S. Pat. No. 7,688,271 uses a printed circuit board-based feed stalk to feed the RF signals to and from the radiator unit thereof, while the radiator unit 940 is designed to be fed directly by a pair of coaxial cables 130-1, 130-2.

Pursuant to further embodiments of the present invention, techniques for grounding radiating elements are provided that may be used to suppress a common mode resonance that may distort the radiation pattern of nearby radiating elements that operate in a different frequency band. These techniques may be used, for example, with any of the radiating elements according to embodiments of the present invention that are disclosed herein. As described above, coaxial feed cables may be used as the feed elements for the radiating elements according to embodiments of the present invention. As is also described above, in some embodiments, the outer conductors of the coaxial feed cables 130 may not be coupled to the reflector 24 underneath the radiating elements, but instead may be coupled to the reflector 24 elsewhere within the antenna. As a result, the outer conductors of the coaxial feed cables 130 may appear as a monopole element that has a length equal to the distance from where the outer conductor of each coaxial feed cable 130 is grounded to the reflector 24 at the point where the coaxial feed cable 130 connects to one of the radiator units (e.g., radiator unit 140) according to embodiments of the present invention. If the monopole element formed by the outer conductor of a coaxial feed cable 130 has a length that is resonant within an operating frequency band of other radiating elements that may be included in the base station antenna, then the coaxial feed cables 130 may generate common mode resonances in the response of these other radiating elements, degrading the performance thereof.

Pursuant to embodiments of the present invention, the points where the outer conductors of the coaxial feed cables 130 for a radiating element are coupled to a common ground reference such as the reflector of an antenna may be selected so that common mode resonances will not be generated in the response of other radiating elements included in the antenna. In particular, the length of the "monopole" segment of each coaxial feed cable that extends from the radiator unit that the coaxial feed cable 130 feeds to the point where the coaxial feed cable 130 is connected to a common ground reference (e.g., the reflector 24) may be set to be a length that will not resonate in the operating frequency band of any other nearby radiating elements. Thus, for example, if the coaxial feed cables are used to feed so-called high band radiating elements that operate in the 1,695-2,690 MHz frequency band that are mounted adjacent other so-called low-band radiating elements that operate in the 696-960 MHz frequency band, then the lengths of the above-described "monopole" segments of the coaxial feed cables 130 will be selected so that they are not resonant in the 696-960 MHz frequency band (e.g., the lengths of the monopole segments will not be equal to a quarter wavelength, a half, wavelength, three quarters of a wavelength, one wavelength, etc. for any frequency within the 696-960 MHz frequency band). This technique may be used to suppress a common mode resonance that otherwise could degrade the performance of the low band radiating elements.

Figure 14A:
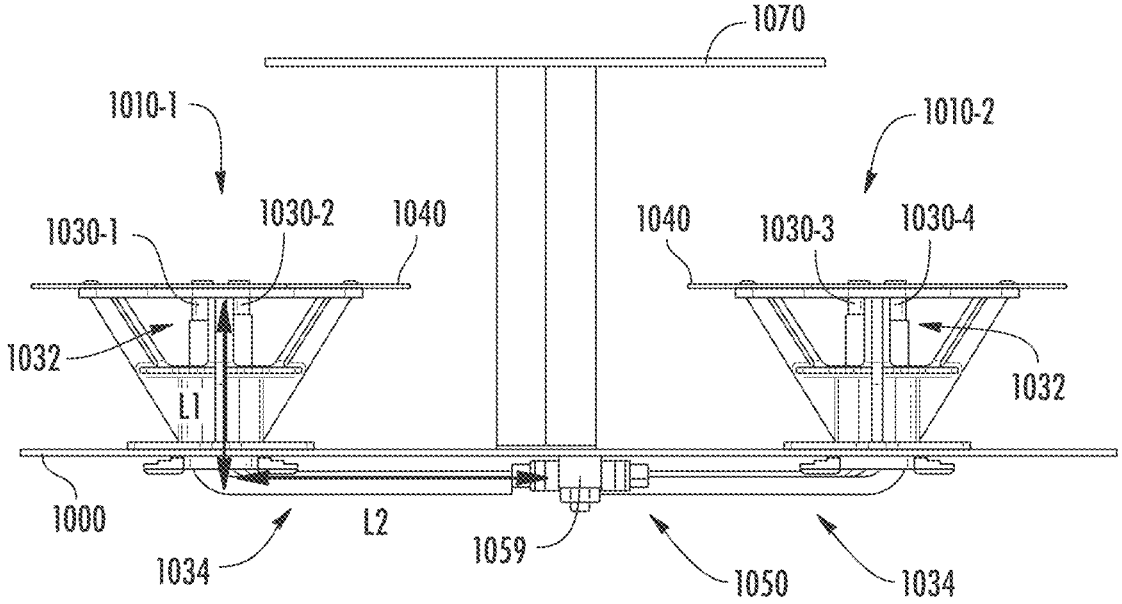
FIG. 14A is a side view of a portion of a base station antenna that includes a pair of radiating elements mounted on a reflector that are fed by a power divider printed circuit board that is mounted behind the reflector.
Figure 14B:
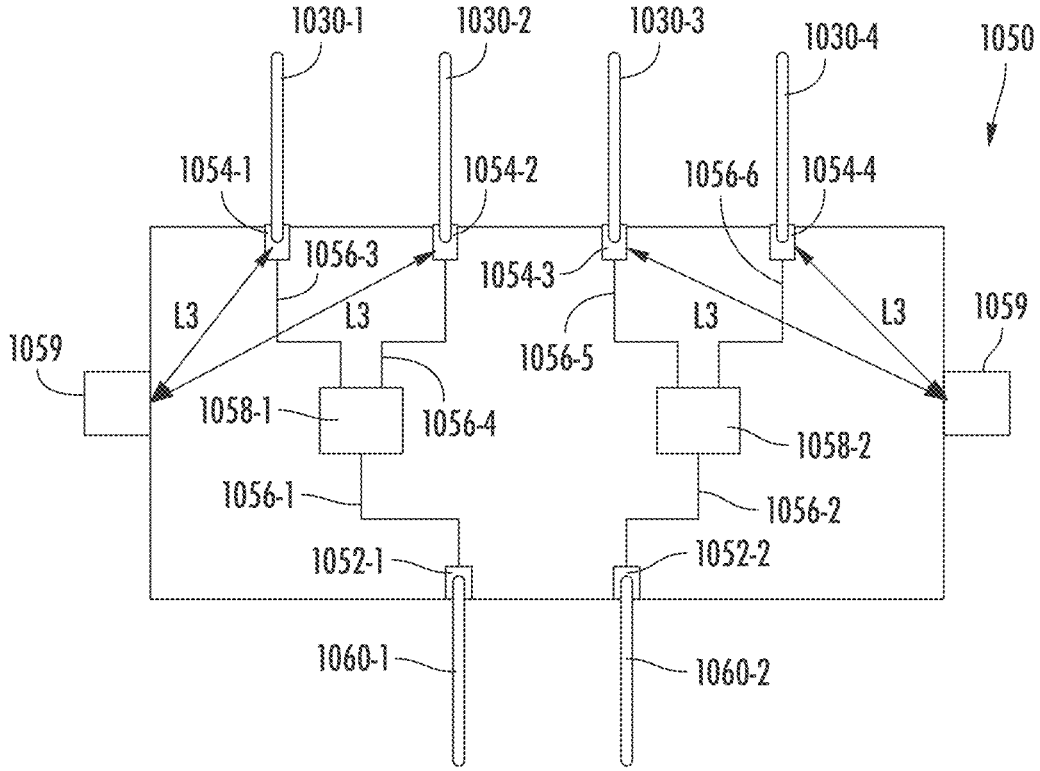
FIG. 14B is a rear view of the power divider printed circuit board of FIG. 14A.

FIG. 14A is a side view of a portion of a base station antenna that includes a pair of radiating elements mounted on a reflector that are fed by a power divider printed circuit board that is mounted behind the reflector. FIG. 14B is a rear view of the power divider printed circuit board of FIG. 14A. FIGS. 14A and 14B will be used to explain how the above-described common mode resonances can be suppressed in nearby radiating elements that operte in different frequency bands.

As shown in FIG. 14A, the base station antenna includes a reflector 1000 and first and second radiating elements 1010-1, 1010-2 that are mounted to extend forwardly from the reflector 1000. The first radiating element 1010-1 is fed by a first pair of coaxial feed cables 1030-1, 1030-2. The second radiating element 1010-2 is fed by a second pair of coaxial feed cables 1030-3, 1030-4. A power divider printed circuit board 1050 is mounted on the rear side of the reflector 1000.

As shown in FIG. 14B, the power divider printed circuit board 1050 includes first and second input ports 1052-1, 1052-2, and first through fourth output ports 1054-1 through 1054-4. First and second input coaxial cables 1060-1, 1060-2 are coupled to the respective first and second input ports 1052-1, 1052-2. The coaxial feed cables 1030-1, 1030-2 for the first radiating element 1010-1 are coupled to the respective first and second output ports 1054-1, 1054-2. The coaxial feed cables 1030-3, 1030-4 for the second radiating element 1010-2 are coupled to the respective third and fourth output ports 1054-1, 1054-2. The power divider printed circuit board 1050 may include transmission lines 1056 such as, for example, microstrip transmission lines and a pair of power divider circuits such as, for example, Wilkinson power dividers 1058. A first transmission line 1056-1 may connect the first input port 1052-1 to an input of the first power divider circuit 1058-1 and third and fourth transmission lines 1056-3, 1056-4 may connect the first and second outputs of the first power divider circuit 1058-1 to the respective first and second output ports 1054-1, 1054-2. Similarly, a second transmission line 1056-2 may connect the second input port 1052-2 to an input of the second power divider circuit 1058-2 and fifth and sixth transmission lines 1056-5, 1056-6 may connect the first and second outputs of the second power divider circuit 1058-2 to the respective third and fourth output ports 1054-3, 1054-4.

As is further shown in FIG. 14B, the power divider printed circuit board 1050 may include one or more grounding tabs 1059 where a ground reference for the transmission lines 1056 is coupled to the reflector 1000. The grounding tabs 1059 may comprise an electrical connection (which may be a galvanic connection or a capacitive connection, for example) between the ground reference for the transmission lines 1056 and the reflector 1000.

As shown in FIG. 14A, a first segment 1032 of each coaxial feed cable 1030 extends forwardly from the reflector 1000 to the radiator unit 1040 of its associated radiating element 1010. The length of each first segment 1032 may be L1, which is typically between a quarter wavelength and three-eighths of a wavelength of the center frequency of the operating frequency band of the radiating element 1010. These segments 1032 may appear as monopoles that extend forwardly from the reflector/ground plane 1000. Each coaxial feed cable 1030 includes a second segment 1034 that extends along the back side the reflector 1000 from the distal end of the first segment 1032 to the power divider printed circuit board 1050. The length of each second segment 1034 may be L2, and the length L2 may be selected by an antenna designed based on the location of the power divider printed circuit board 1050. As shown in FIG. 14B, each output port 1054 on power divider printed circuit board 1050 may be located a distance L3 from the closest ground tab 1059 (note that the distance L3 may be different for each output port 1054).

RF energy emitted by another radiating element 1070 that operates in a different frequency band may be present in the vicinity of the first segments 1032 of the coaxial feed cables 1030. As noted above, the first segments 1032 of the coaxial feed cables 1030 may appear as monopole elements that extend forwardly from the reflector 1000. Moreover, since each coaxial feed cable 1030 has a ground connection to the reflector 1000 at one of the grounding tabs 1059, the effective length of these monopole elements is not the length L1 of the first segments 1032 that extend forwardly from the reflector 1000, but instead is the sum of L1+L2+L3 for each coaxial feed cable 1030. If this effective length is a length that is resonant within the operating frequency band of the radiating element 1070, then the RF energy emitted by radiating element 1070 may induce currents on the coaxial feed cables 1030, generating the common mode resonance in the frequency response of the radiating element 1070. This common mode resonance will occur in a relatively tight range of frequencies for which the effective length of the monopole element is resonant within the operating frequency band of radiating element 1070. Unfortunately, this common mode resonance can degrade the performance of radiating element 1070.

An antenna designer may select the distance L2 based on the location of the power divider printed circuit board 1050 with respect to the radiating elements 1010, and may select the distance L3 based on the size of the power divider printed circuit board and the locations of the grounding tabs 1059 and the output ports 1054. As such, the antenna designer can select the effective length of the monopole element formed by each coaxial feed cable 1030. By selecting these effective lengths to not be lengths where the monopole elements will be resonant in the operating frequency band(s) of other nearby radiating elements, the generation of a common mode resonance in the response of the nearby radiating elements may be suppressed.

While FIGS. 14A and 14B illustrate an example where the radiating elements 1010-1, 1010-2 are fed through a power divider printed circuit board 1050, it will be appreciated that embodiments of the present invention are not limited thereto. For example, in other embodiments, the coaxial feed cables 1030 may connect to a phase shifter or other circuit element that may or may not include a grounding tab. Moreover, if a grounding tab is not provided, the coaxial feed cables may be grounded to the reflector in other ways. For example, a small portion of the cable jacket of each coaxial feed cable 1030 may be removed and the outer conductor of each coaxial feed cable 1030 that is exposed through the opening in the cable jacket may be soldered to the reflector 1000 to provide the ground reference. When this approach is taken, the effective length of each monopole element may be L1+L2, where L2 is the length of the second cable segment 1034 that extends between cable segment 1032 and the point where the coaxial feed cable 1030 is soldered to the reflector 1000.

The radiating elements discussed above have primarily been implemented using radiator unit printed circuit boards having two metal layers, with a conductive patch of the radiating element implemented at least primarily on one metal layer and the feed network implemented primarily on the other layer of the printed circuit board. Embodiments of the present invention, however, are not limited thereto. For example, FIGS. 15A-15D illustrate a radiating element 1100 according to further embodiments of the present invention that is implemented primarily from sheet metal. Sheet metal radiating elements may be cheaper than corresponding printed circuit board based radiating elements, and allow for three-dimensional radiator units that may have a smaller size or "footprint" on the reflector of the antenna. This smaller footprint may allow an array formed of the radiating elements to be positioned closer to other arrays of radiating elements, allowing for a reduction in the size of an antenna including these radiating elements and/or the inclusion of more arrays in the antenna.

Figure 15A:
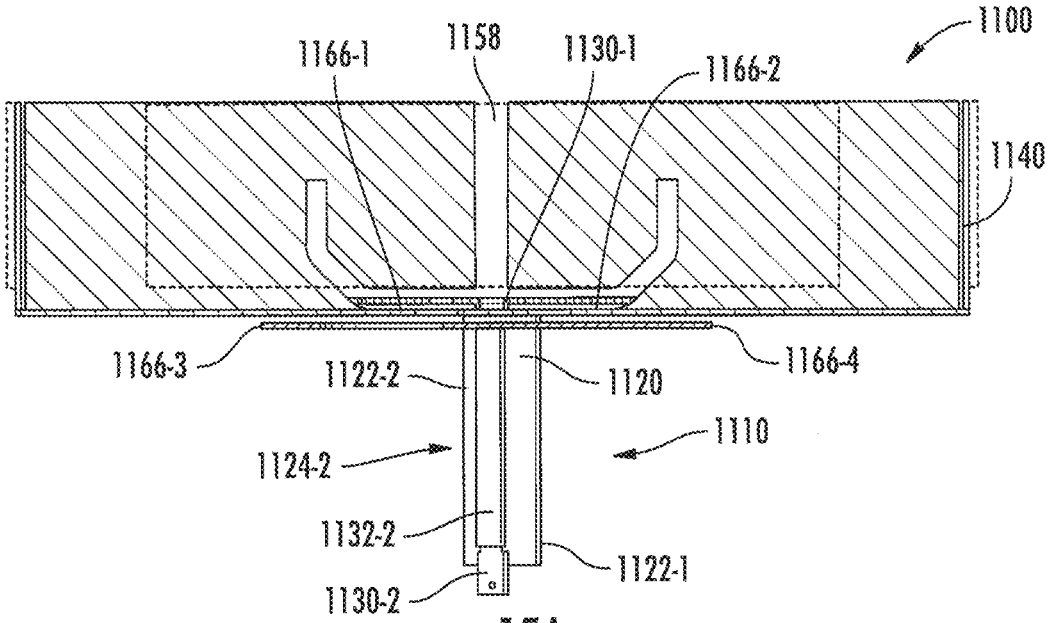
FIG. 15A is a side view of a sheet metal based radiating element according to still further embodiments of the present invention.
Figure 15B:
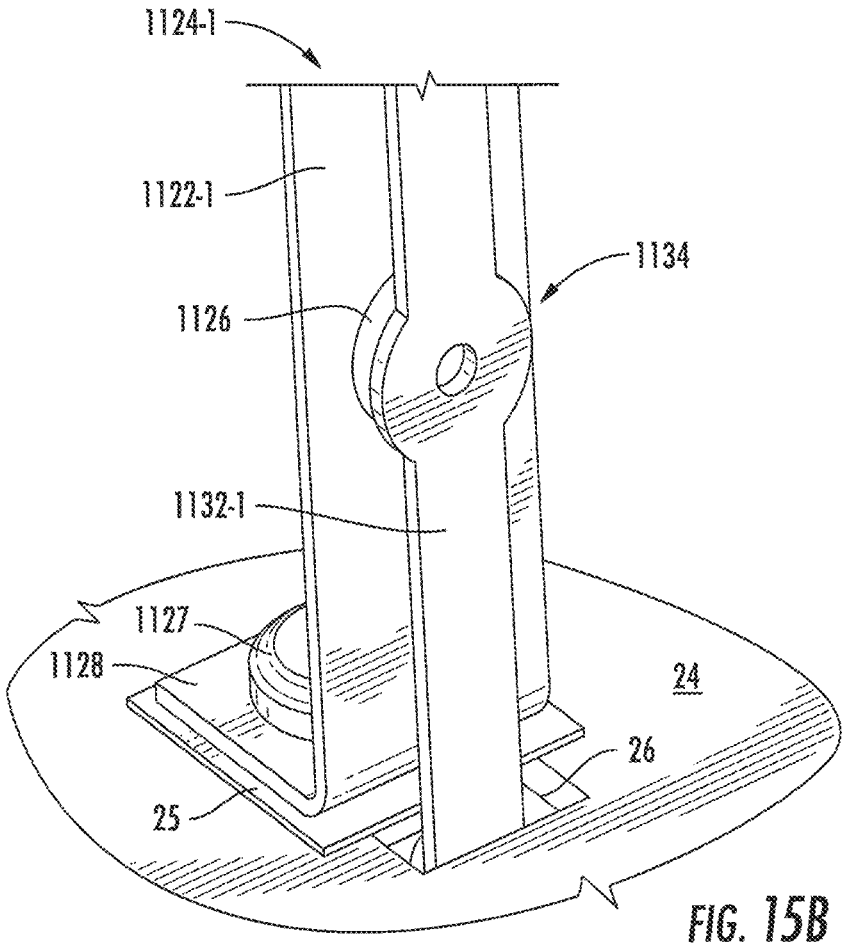
FIG. 15B is a schematic view of a lower portion of one of the metal plates of the feed stalk of the radiating element of FIG. 15A illustrating how a feed line may be mounted thereon to form a microstrip feed line.

Referring first to FIGS. 15A-15B, FIG. 15A is a side view of the sheet metal based radiating element 1100, while FIG. 15B is a schematic view of a lower portion of one of the metal plates of the feed stalk of the radiating element of FIG. 15A illustrating how a feed line may be mounted thereon to form a microstrip feed line.

As shown in FIGS. 15A-15B, the radiating element 1100 includes a feed stalk 1110 and a radiator unit 1140. The feed stalk 1110 is used to mount the radiator unit 1140 forwardly of the reflector (not shown) of a base station antenna. The feed stalk 1110 includes an L-shaped metal stalk 1120 and a pair of traces 1132-1, 1132-2. It will be appreciated that the metal feed stalk 1120 may have other shapes (cross-sections) such as, for example, square shape, triangular shape, cruciform shape, etc. Each trace 1132 is part of a larger feed structure 1130, as will be discussed below. The L-shaped metal stalk 1120 includes first and second metal plates 1122-1, 1122-2, which may comprise a single piece of metal that is bent at a 90° angle to define the two plates 1122-1, 1122-2. The first trace 1132-1 is mounted on the first metal plate 1122-1 and the second trace 1132-2 is mounted on the second metal plate 1122-2 so as to form first and second microstrip transmission lines 1124-1, 1124-2, with the metal plates 1122 serving as the ground conductors of the microstrip transmission lines 1124 and the traces 1132 serving as the signal traces of the respective microstrip transmission lines 1124.

As shown in FIG. 15B, the traces 1132 may be mounted on the respective metal plates 1122 using, for example, dielectric stand-off rivets 1126 that mount each trace 1132 at a predetermined distance from its associated metal plate 1122, where the predetermined distance may be selected so that the microstrip transmission lines 1124 may have a desired impedance. The traces 1132 may have features 1134 such as widened areas and or openings that mate with the dielectric stand-off rivets 1126 that facilitate mounting the traces 1132 to the metal plates 1122 and maintaining the desired impedance. As shown in FIG. 15B, a rear portion of each metal plate 1122 may be bent at a 90° angle (other angles may be used; preferably an angle of at least 30° is used to obtain a significant reduction in the size of the radiating element) to form a tab 1128 that facilitates mounting the metal stalk 1120 to extend forwardly from a reflector 24 using dielectric rivets 1127. A dielectric pad 25 may be interposed between the reflector 24 and the tab 1128. Alternatively, metal rivets may be used and the dielectric pad 25 may be omitted to provide a galvanic connection instead of a capacitive connection between the metal stalk 1120 and the reflector 24. First and second coaxial feed cables (not shown) may be electrically coupled to the microstrip transmission lines 1124. For example, the outer (ground) conductor of each coaxial feed cable may be soldered to the reflector 24 and capacitively coupled to the metal stalk 1120 through the dielectric pads 25, and the traces 1132 may extend rearwardly through openings 26 in the reflector 24 so that the inner conductors of the respective first and second coaxial feed cables may be soldered to the rear end of each trace 1132 behind the reflector 24. The first and second coaxial feed cables may connect the radiating element 1100 to another component of a base station antenna such as an electromechanical phase shifter assembly or a power divider.

While the feed stalk 1110 of FIGS. 15A-15B comprises a metal stalk 1120 and a pair of traces 1132-1, 1132-2, it will be appreciated that in other embodiments other types of feed stalks may be used such as, for example, coaxial feed cables, printed circuit board feeds, etc.).

Figure 15C:
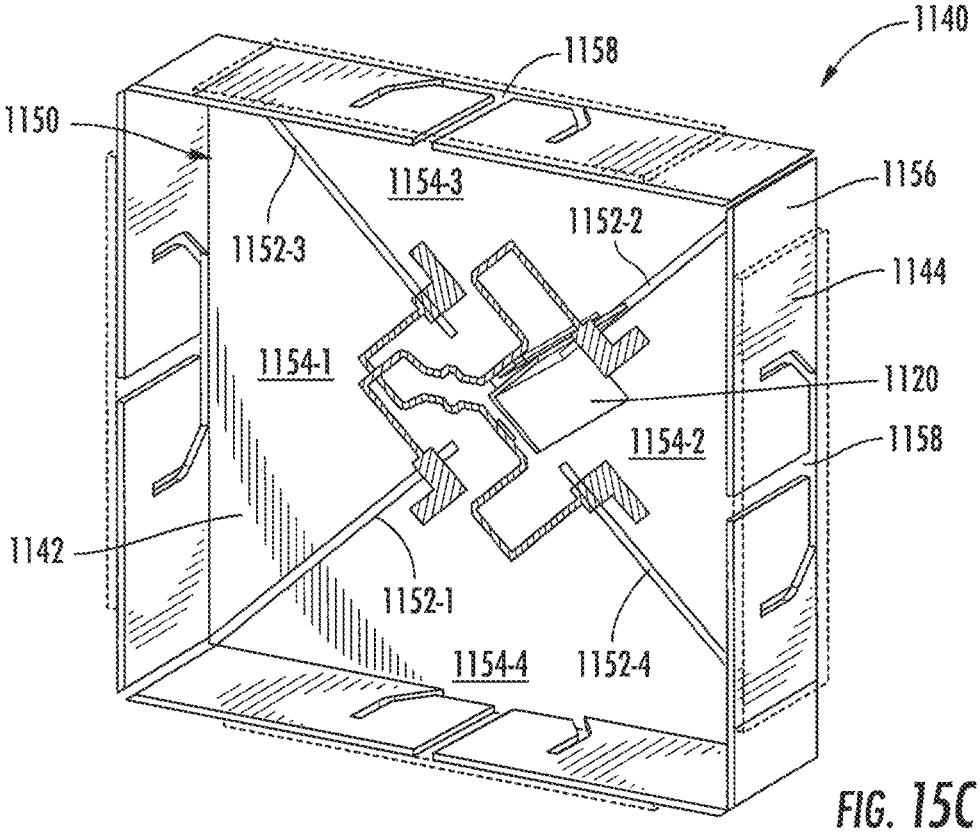
FIG. 15C is a front perspective shadow view of a radiator unit of the radiating element of FIG. 15A.
Figure 15D:
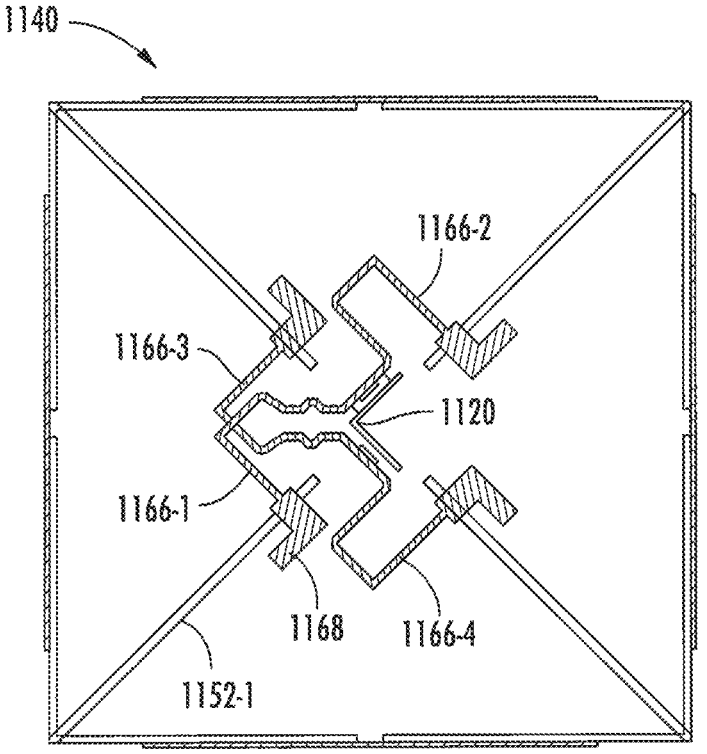
FIG. 15D is a front shadow view of the radiator unit of FIG. 15C.

FIGS. 15C and 15D are a front perspective shadow and a front shadow view, respectively, of a radiator unit 1140 of the radiating element 1100 of FIG. 15A. Referring to FIGS. 15C-15D, the radiator unit 1140 may be mounted on a forward end of metal stalk 1120 via, for example, soldering. The radiator unit 1140 may be implemented using pieces of stamped sheet metal and four small printed circuit boards. A first piece of sheet metal 1142 may form a conductive patch 1150. The first piece of sheet metal 1142 may have a square shape and may be formed by stamping the square piece of sheet metal 1142 to form a plurality of slots 1152, 1154 therein, and then bending the four outer edges 1156 of the piece of sheet metal 1142 upward at an angle of about 90° (FIGS. 15A and 15C). The four outer edges 1156 may be bent downwardly in other embodiments, or some of the outer edges 1156 may be bent upwardly and others downwardly. The outer edges 1156 may each be bent at an angle of at least 30°, or at an angle of at least 45°, or at an angle of at least 60°. In some embodiments, the outer edges 1156 may each be bent at an angle of approximately 90° with respect to the inner portions of the arms 1154. Slots 1152-1 through 1152-4 extend radially from a respective point near the center of the first piece of sheet metal 1142 to the periphery of the conductive patch 1150. Each of the first through fourth slots 1152-1 through 1152-4 includes a first portion that extends in a plane defined by an inner portion (the central region) of the conductive patch 1150, and a second portion that extends at an oblique angle with respect to the first portion. Each slot 1152 may be rotationally offset from adjacent slots by −90° and 90°, respectively. The slots 1152 extend through the upwardly bent outer edges 1156 of the square piece of sheet metal 1142, and hence each slot 1152 extends to the periphery of the conductive patch 1150.

The first and second slots 1152-1, 1152-2 may extend along a first common plane and the third and fourth slots 1152-3, 1152-4 may extend along a second common plane that is perpendicular to the first common plane. Each of the slots 1152 may extend from a periphery of the conductive patch 1150 towards the middle or "central region" of the conductive patch 1150, and the four slots 1152 may divide the conductive patch 1150 into the four arms 1154-1 through 1154-4. The four arms 1154 are electrically connected to each other in a central region of the conductive patch 1150 and extend outwardly from the central region of the conductive patch 1150.

Openings in the form of slots 1158-1 through 1158-4 are formed in the respective upwardly bent outer edges 1156 of the square piece of sheet metal 1142. Thus, a slot 1158 is formed in each arm 1154. The slots 1158 may be generally T-shaped slots in some embodiments, as shown. Each slot 1158 may extend to a distal portion of a respective arm 1154. Four small printed circuit boards 1144 are provided. Each printed circuit board 1144 includes a dielectric substrate (not shown) that directly contacts a respective one of the upwardly bent outer edges 1156 of the square piece of sheet metal 1142, and a metal layer formed on the outer side of dielectric substrate. Each printed circuit board 1144 overlaps a respective one of the upwardly bent outer edges of the square piece of sheet metal 1142. The printed circuit boards 1144 may be attached to the upwardly bent outer edges 1156 of the square piece of sheet metal 1142 be any appropriate fashion including, for example, adhesives, double-sided tapes, rivets, screws or other fasteners. Each printed circuit board 1144 may cover a respective one of the slots 1158. In other embodiments, the printed circuit boards 1144 may be replaced with metal sheets that may be attached to the upwardly bent outer edges 1156 of the square piece of sheet metal 1142 via adhesive tape or other means that allow the metal sheets to capacitively couple to the upwardly bent outer edges 1156 of the square piece of sheet metal 1142. Each metal layer (whether in the form of a metal layer on a printed circuit board 1144 or a metal sheet) may capacitively couple with the outer edge 1156 of a respective one of the arms 1154.

As noted above, the traces 1132-1, 1132-2 are each part of a respective feed structure 1130-1, 1130-2. Each feed structure 1130-1, 1130-2 may comprise a monolithic piece of stamped and bent sheet metal. Feed structure 1130-1 includes first and second feed lines 1166-1, 1166-2, while feed structure 1130-2 includes third and fourth feed lines 1166-3, 1166-4. Thus, the first and second feed lines 1166-1, 1166-2 are physically and electrically connected to the first trace 1132-1, and the third and fourth feed lines 1166-3, 1166-4 are electrically connected to the second trace 1132-2.

Feed line 1166-1 crosses the first slot 1152-1 and feed line 1166-2 crosses the second slot 1152-2. Accordingly, RF signals that are incident on the first trace 1132-1 split so that a portion of the RF energy passes to each of the first and second feed lines 1166-1, 1166-2. Feed line 1166-3 crosses the third slot 1152-3 and feed line 1166-4 crosses the fourth slot 1152-4. Thus, RF signals that are incident on the second trace 1132-2 split so that a portion of the RF energy passes to each of the third and fourth feed lines 1166-3, 1166-4. The RF energy passes along each feed line 1166 to cross a respective one of the slots 1152. Each feed line 1166 terminates into a respective one of four quarter wavelength stubs 1168. As a result, RF signals that are input on feed lines 1166-1 through 1166-4 feed the respective slots 1152-1 through 1152-4, causing the conductive patch 1150 to radiate RF energy.

The first and second feed lines 1166-1, 1166-2 are positioned forwardly of the conductive patch 1150, as can best be seen in FIG. 15A. The third and fourth feed lines 1166-3, 1166-4 are positioned rearward of the conductive patch 1150. A pair of dielectric spacers (not shown) are provided, the first of which is interposed between the first and second feed lines 1166-1, 1166-2 and the conductive patch 1150, and the second of which is interposed between the third and fourth feed lines 1166-3, 1166-4 and the conductive patch 1150. The dielectric spacers may physically and electrically separate the first and second feed structures 1130-1, 1130-2 from the first piece of metal 1142. Each feed line 1166 may comprise an air microstrip transmission line. In other embodiments, the feed lines 1166 may comprise conventional microstrip transmission lines.

Figure 15E:
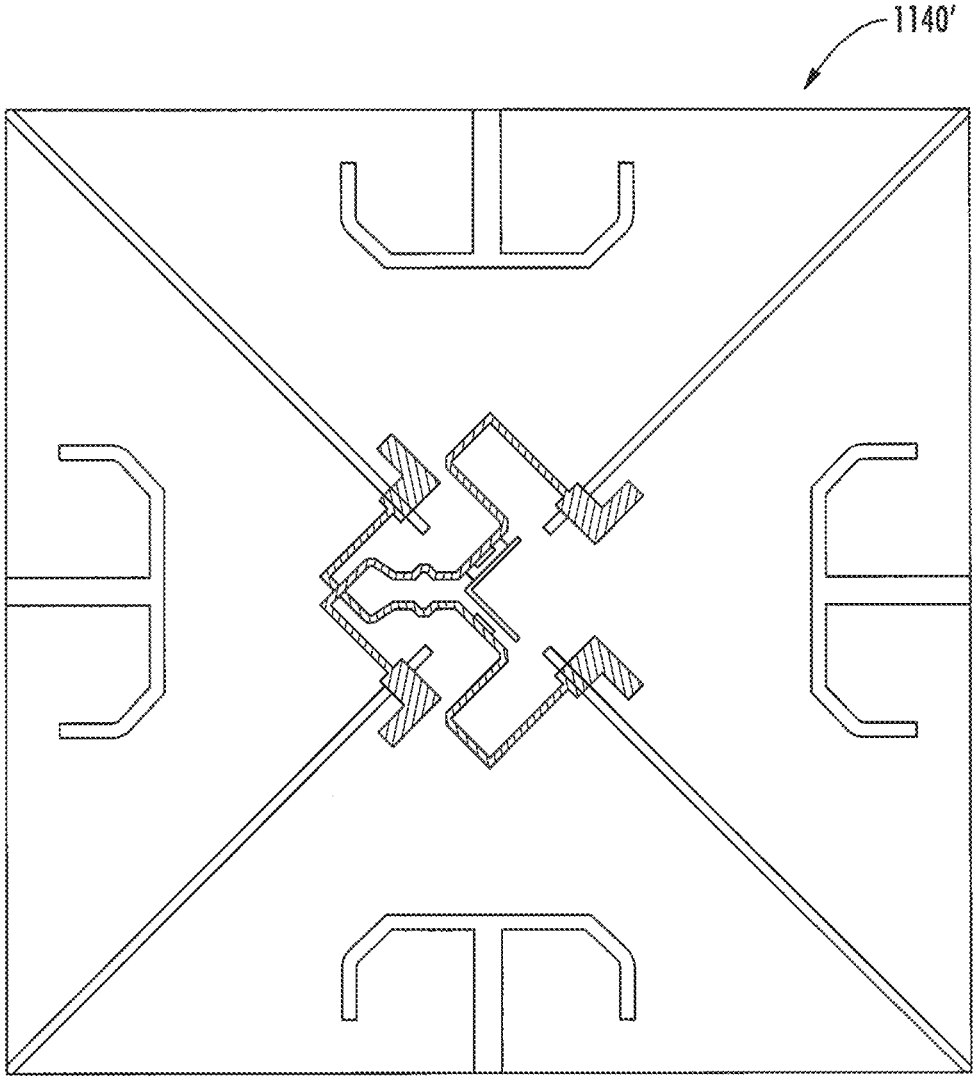
FIG. 15E is a front shadow view of a modified version of the radiator unit of FIGS. 15C-15D.

It will be appreciated that many modifications may be made to the radiating element 1100 of FIGS. 15A-15D. For example, FIG. 15E is a front shadow view of a modified version of a radiator unit 1140' that may be used in place of the radiator unit 1140 in the radiating element 1100. The radiator unit 1140' may be identical to the radiator unit 1140 of FIGS. 15C-15D except that the outer edges 1156 of radiator unit 1140' are not bent upwardly or downwardly so that the conductive patch 1150 is a planar element.

Figure 15F:
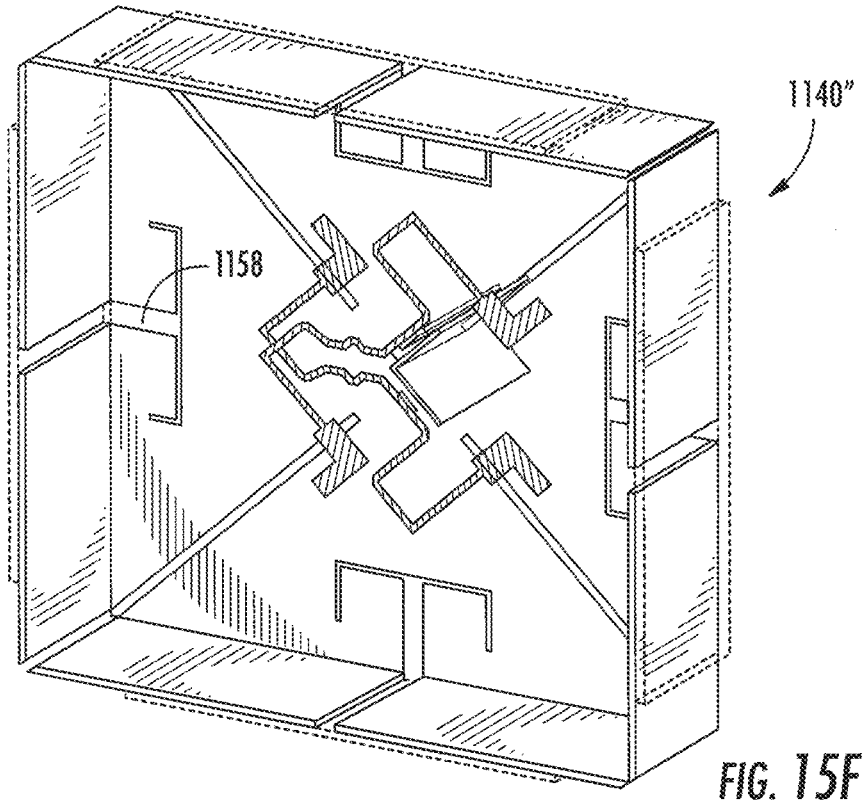
FIGS. 15F and 15G are a front perspective shadow view and a front shadow view, respectively, of another modified version of the of the radiator unit of FIGS. 15C-15D.
Figure 15G:
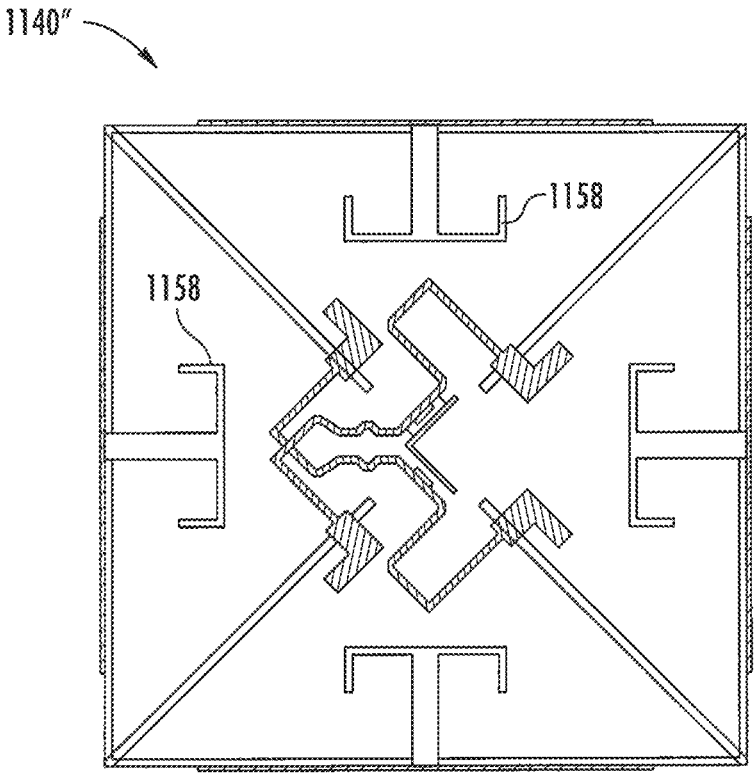

FIGS. 15F and 15G are a front perspective shadow view and a front shadow view, respectively, of another modified version 1140" of the radiator unit of FIGS. 15C-15D. As shown in FIGS. 15F and 15G, the radiator unit 1140" is identical to the radiator unit 1140 except that the base of the T-shaped slots 1158 is extended so that the slots 1158 extend farther into the interior of the conductive patch 1150.

Notably, positioning the first and second feed lines 1166-1, 1166-2 on one side of the conductive patch 1150 while positioning the third and fourth feed lines 1166-3, 1166-4 on the other side of the conductive patch 1150 eliminates any need to provide special structures to prevent conductive lines 1166-1 and 1166-3 from electrically short-circuiting at the location where they "cross" when viewed from the front. However, it will be understood that all of the feed lines 1166 may be implemented on the same side (either front or back) of the conductive patch 1150 in other embodiments, as shown above with respect to other radiating elements according to embodiments of the present invention.

While monolithic sheet metal feed structures 1130-1, 1130-2 are used in the depicted embodiment, it will be appreciated that in other embodiments the first and second feed lines 1166-1, 1166-2 may be implemented using a first printed circuit board, and that the third and fourth feed lines 1166-3, 1166-4 may be implemented using a second printed circuit board. The traces 1132-1, 1132-2 may be electrically coupled to the respective printed circuit boards. If printed circuit boards are used, the feed branches may be implemented as coplanar waveguide or grounded coplanar waveguide transmission lines in the same manner discussed above with other embodiments of the present invention.

Bending the outer edges of the first piece of stamped metal 1142 may reduce the "footprint" of the radiating element 1100 (i.e., the area of the radiating element 1100 when viewed from the front). This may allow an array of radiating elements 1100 included in an antenna to be positioned closer to other arrays. As the radiating element 1100 may be formed primarily of stamped sheet metal it may be cheaper to fabricate than comparable radiating elements formed using printed circuit boards.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A radiating element for a base station antenna, the radiating element comprising:

a printed circuit board that includes a conductive patch having first and second slots that each extend along a first axis and third and fourth slots that each extend along a second axis that is perpendicular to the first axis;

a first coaxial cable and a second coaxial cable that each extend from a reflector of the base station antenna to the printed circuit board; and a conductive stub that physically and electrically connects an outer conductor of the first coaxial cable to an outer conductor of the second coaxial cable.

2. The radiating element of claim 1, wherein the printed circuit board is mounted forwardly from the reflector at a distance that is greater than one-quarter of a wavelength corresponding to the center frequency of the operating frequency band of the radiating element.

3. The radiating element of claim 2, wherein the conductive stub is located at approximately one quarter of the wavelength corresponding to the center frequency of the operating frequency band of the radiating element from the printed circuit board.

4. The radiating element of claim 2, wherein the conductive stub is located closer to the reflector than it is to the printed circuit board.

5. The radiating element of claim 1, wherein the outer conductors of the first and second coaxial cables are soldered to the printed circuit board.

6. The radiating element of claim 1, further comprising first and second conductive tubes that are positioned adjacent the first and second coaxial cables.

7. The radiating element of claim 1, wherein the printed circuit board further includes a feed network that has a first input that is electrically connected to an inner conductor of the first coaxial cable, a first power divider that is coupled to the first input, first and second transmission lines that extend from the first power divider to cross the respective first and second slots, a second input that is electrically connected to an inner conductor of the second coaxial cable, a second power divider that is coupled to the second input, and third and fourth transmission lines that extend from the second power divider to cross the respective third and fourth slots.

8. The radiating element of claim 7, wherein the conductive patch is implemented at least partially on a first metal layer of the printed circuit board, wherein the feed network is implemented on a second metal layer of the printed circuit board, wherein the second metal layer further includes a plurality of metal pads that are each electrically connected to the conductive patch, and wherein each of the first through fourth slots extend to a periphery of the conductive patch.

9. The radiating element of claim 7, wherein at least a portion of the conductive patch is implemented on a first metal layer of the printed circuit board, wherein the first through fourth transmission lines comprise metal traces on a second metal layer of the printed circuit board, and wherein each of the first through fourth slots extend to the periphery of the conductive patch.

10. The radiating element of claim 9, wherein the conductive patch includes a first portion that is implemented on a first metal layer of a printed circuit board and a second portion that is implemented on the second metal layer of the printed circuit board.

11. The radiating element of claim 1, wherein the printed circuit board further includes a conductive ring that at least partially surrounds a periphery of the conductive patch and that encloses each of the first through fourth slots.

12. A method of suppressing a common mode resonance in a base station antenna having a reflector, an array of first radiating elements that are configured to operate in a first operating frequency band and an array of second radiating elements that are configured to operate in a second operating frequency band, where each second radiating element includes a radiator unit that is positioned forwardly of the reflector and at least one coaxial feed cable that connects to the radiator unit, the method comprising:

electrically connecting an outer conductor of a first of the coaxial feed cables that feeds a first of the second radiating elements to the reflector at a grounding position that is selected so that the physical distance of the radio frequency ("RF") transmission path that extends between the grounding position and the radiator unit of the first of the second radiating elements is a distance that is not resonant at any frequency in the first operating frequency band.

13. The method of claim 12, wherein the grounding position is a position where an outer conductor of the first of the coaxial feed cables is galvanically connected to a rear surface of the reflector.

14. The method of claim 13, where the first of the coaxial feed cables is galvanically connected to a rear surface of the reflector by exposing a portion of the outer conductor and soldering the exposed portion of the outer conductor to the reflector.

15. The method of claim 12, wherein the first of the coaxial feed cables extends between the radiator unit and a printed circuit board, and wherein the printed circuit board includes a grounding tab where a ground conductor of the printed circuit board is coupled to the reflector.

16. The method of claim 15, wherein the physical distance of the RF transmission path that extends between the grounding position and the radiator unit of the first of the second radiating elements is the sum of the length of the first of the coaxial feed cables and a distance between the location where the first of the coaxial feed cables connects to the printed circuit board and the grounding tab.

17. The method of claim 12, wherein the physical distance of the RF transmission path that extends between the grounding position and the radiator unit of the first of the second radiating elements is not a multiple of a quarter wavelength of any frequency in the first operating frequency band.

18. The method of claim 12, wherein a second of the coaxial feed cable also feeds the first of the second radiating elements, and wherein a conductive stub physically and electrically connects an outer conductor of the first of the coaxial feed cables to an outer conductor of the second of the coaxial feed cables.

19. The method of claim 18, wherein the radiator unit of first of the second radiating elements is mounted forwardly from the reflector at a distance that is greater than one-quarter of a wavelength corresponding to the center frequency of the second operating frequency band, and the conductive stub is located at approximately one quarter of the wavelength corresponding to the center frequency of the second operating frequency band of the radiating element from the radiator unit.

20. The method of claim 19, wherein the conductive stub is located closer to the reflector than it is to the radiator unit.

* * * * *